US007684728B2

(12) United States Patent
Okabe et al.

(10) Patent No.: US 7,684,728 B2
(45) Date of Patent: Mar. 23, 2010

(54) IMAGE FORMING APPARATUS, PROCESS UNIT AND DEVELOPING CARTRIDGE

(75) Inventors: Yasushi Okabe, Nagoya (JP); Naoya Kamimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 231 days.

(21) Appl. No.: 11/535,609

(22) Filed: Sep. 27, 2006

(65) Prior Publication Data

US 2007/0077087 A1 Apr. 5, 2007

(30) Foreign Application Priority Data

Sep. 30, 2005 (JP) ..... 2005-288200

(51) Int. Cl.
*G03G 21/16* (2006.01)
*G03G 21/18* (2006.01)
*G03G 15/04* (2006.01)

(52) U.S. Cl. ..... 399/111; 399/113; 399/119

(58) Field of Classification Search ..... 399/111, 399/113, 119, 120
See application file for complete search history.

(56) References Cited

U.S. PATENT DOCUMENTS 5,634,178 A 5/1997 Sugiura et al.
6,708,011 B2 3/2004 Nomura et al.
2004/0184835 A1* 9/2004 Park ..... 399/116

FOREIGN PATENT DOCUMENTS

JP 4-181953 A 6/1992
JP 6-314001 A 11/1994
JP 7-056431 A 3/1995
JP 2003-015378 A 1/2003
JP 2004-034465 A 2/2004
JP 2004-304693 A 10/2004
JP 2005-091410 A 4/2005

OTHER PUBLICATIONS

JP Office Action dtd Oct. 30, 2008, JP Appln. 2005-288200.

* cited by examiner

*Primary Examiner*—Hoang Ngo
(74) *Attorney, Agent, or Firm*—Banner & Witcoff, Ltd.

(57) ABSTRACT

An image forming unit includes a process unit including image carrier holder units arranged in one direction and held in the process unit and developing cartridges provided in correspondence with the image carrier holder units and configured to be removably mounted in the image carrier holder units. Each image carrier holder unit includes an image carrier, a charger configured to charge the image carrier, a pair of side frames disposed to hold the image carrier therebetween, a center frame disposed between the side frames, the center frame being configured to support the charger, and a first support portion disposed on the center frame. Each developing cartridge includes a developer frame, a developer carrier provided in the developer frame, and a supported portion provided in the developer frame and configured to face the center frame when the developing cartridge is mounted in the image carrier holder unit.

46 Claims, 37 Drawing Sheets

IMAGE FORMING APPARATUS, PROCESS UNIT AND DEVELOPING CARTRIDGE

CROSS REFERENCE TO RELATED APPLICATION

This application claims priority from Japanese Patent Application No. 2005-288200, filed on Sep. 30, 2005, the entire subject matter of which is incorporated herein by reference.

FIELD

Aspects of the invention relate to an image forming apparatus, such as a laser printer and a process unit and a developing cartridge for use in the image forming apparatus.

BACKGROUND

A known image forming apparatus is provided with photosensitive members, which are horizontally arranged in tandem, in correspondence with yellow, magenta, cyan and black toner. Such a tandem image forming apparatus can print in color at substantially the same speed as printing in monochrome, because a toner image of each color is formed at substantially the same time on each corresponding one of the photosensitive members and each of the different colored images is sequentially laid on top of a sheet while the sheet passes through the photosensitive members.

As disclosed in, for example, Japanese Laid-Open Patent Publication No. 2003-15378, a tandem image forming apparatus is proposed that includes a frame for integrally supporting photosensitive members, each associated with one color. The frame is slidably installed in or removed from a main body of the image forming apparatus. A developing cartridge for developing an electrostatic latent image formed on each of the photosensitive members is removably set in the frame.

In the image forming apparatus disclosed in the Japanese Laid-Open Patent Publication No. 2003-15378 or its counterpart U.S. Pat. No. 6,708,011, a plate-like guide projection is formed on each side of the developing cartridge so as to extend vertically. A guide groove for receiving the guide projection is formed on an upper inner portion of each side plate of the frame at a position corresponding to each photosensitive member. The guide projections are inserted into the guide grooves from above, to set the developing cartridge in the frame or remove the developing cartridge from the frame along the guide grooves.

A developing roller shaft is disposed below the guide projection on each side of the developing cartridge having the guide projection formed thereon. When force is input to the developing roller shaft to rotate the shaft, stress is applied to the guide projection in its thickness direction, so that the guide projection may be broken.

SUMMARY

According to illustrative aspects of the invention, a developing cartridge can be provided that prevents a projection from being broken when a developer carrier is driven. Also, a process unit and an image forming apparatus including the developing cartridge are provided.

BRIEF DESCRIPTION OF THE DRAWINGS

Illustrative aspects of the invention will be described in detail with reference to the following figures in which like elements are labeled with like numbers and in which.

DETAILED DESCRIPTION

Illustrative aspects of the invention will be described in detail below with reference to the accompanying drawings.

First, general structures of a color laser printer 1 will be described below.

Figure 1:
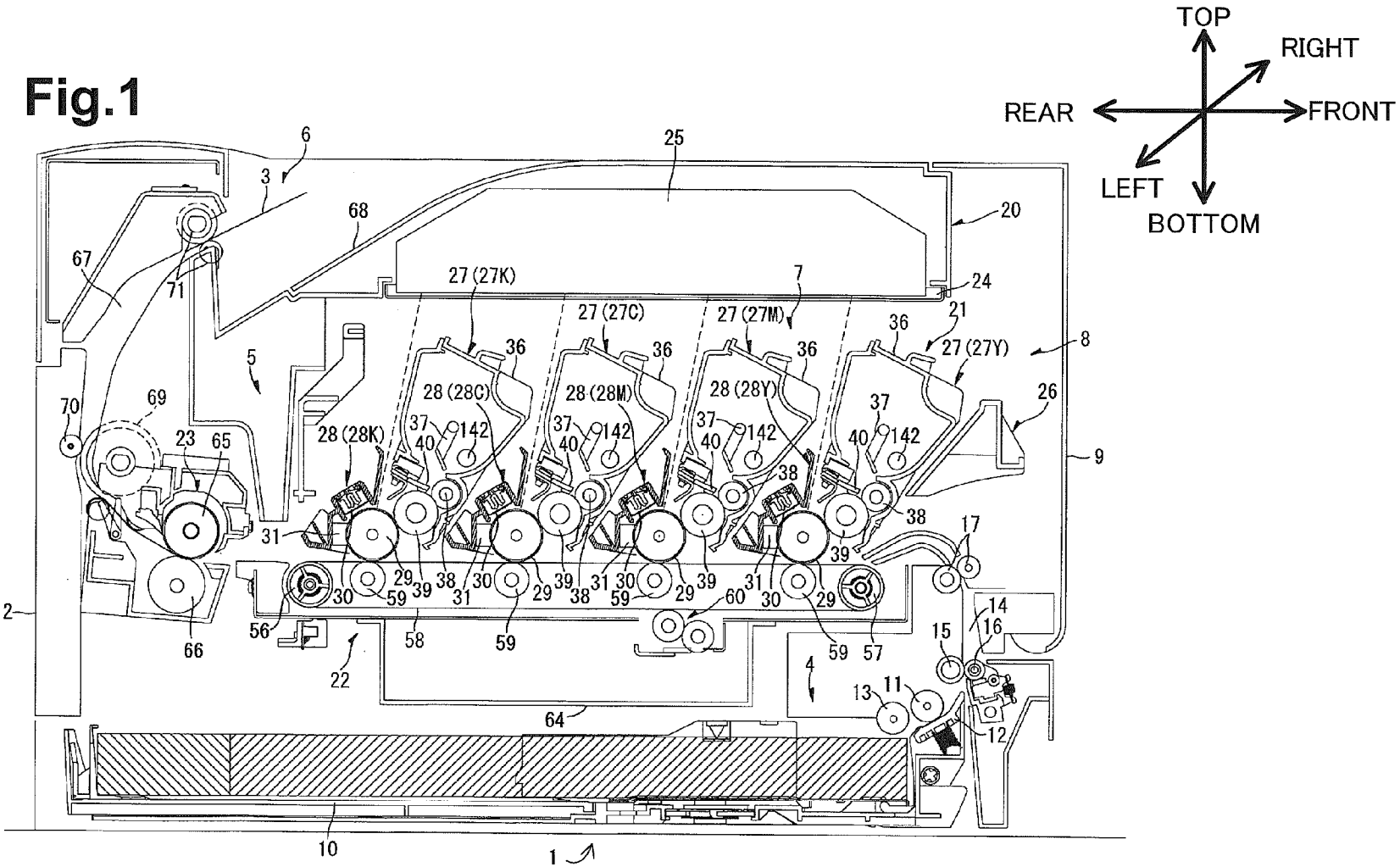
FIG. 1 is a sectional side view showing a general structure of a color laser printer as an image forming apparatus according to an illustrative aspect of the invention.

In FIG. 1, the color laser printer 1 is a tandem color laser printer in which drum sub units 28 are arranged in tandem in a horizontal direction. The color laser printer 1 includes, in a body casing 2, a sheet supply section 4 that supplies a sheet 3, an image forming section 5 that forms an image on the sheet 3 fed therein, and a sheet ejection section 6 that ejects the sheet 3 on which the image is formed.

In the following description, the right side in FIG. 1 is referred to as the front side of the printer 1, and an opposite side (the left side in FIG. 1) is referred to as the rear side of the printer 1, as shown in arrows in FIG. 1. The right and left sides of the printer 1 are defined when the printer 1 is viewed from the front side. More specifically, the left and right sides of the printer 1 are front and rear sides, respectively, in a direction perpendicular to the sheet of FIG. 1. Unless otherwise specified, the front, rear, left, right, top and bottom of the drum unit 26 and a developing cartridge 27 are defined in conjunction with an orientation in which the drum unit 26 and the developing cartridge 27 are installed in the body casing 2.

The body casing 2 has a substantially rectangular box shape in a side view. The body casing 2 has a drum accommodating space 7 for accommodating a drum unit 26, which will be described in detail below.

An opening 8 that communicates with the drum accommodating space 7 is provided at one end in the body casing 2. A front cover 9 to cover or uncover the opening 8 is disposed at the front side (right side in FIG. 1) of printer 1. The front cover 9 is supported so as to open and close by a pair of cover support members 398 (FIG. 26), so that the front cover 9 is movable between an open position where the front cover 9 is inclined frontward of the body casing 2 to uncover the opening 8, and a closed position where the front cover 9 is in an upright position along the front face of the body casing 2 to cover the opening 8. With the opening 8 in the open position, the drum unit 26 can be inserted in or removed from the drum accommodating space 7 through the opening 8.

The sheet supply section 4 is provided at a bottom portion of the body casing 2. The sheet supply section 4 includes a sheet supply tray 10, a separation roller 11, a separation pad 12, a pickup roller 13, and a sheet supply path 14. The sheet supply tray 10 holds sheets 3 therein. The separation roller 11 and the separation pad 12 are disposed at the upper front end of the sheet supply tray 10 to face each other. The pickup roller 13 is disposed behind the separation roller 11. The sheets 3 are fed along the sheet supply path 14.

The sheet supply path 14 is formed in a substantially U shape viewed from a side. An upstream end of the sheet supply path 14 in a sheet feeding direction is disposed near the separation roller 11. A downstream end of the sheet supply path 14 is disposed near a front side of a conveyor belt 58 (described below). A sheet dust removing roller 15 and a pinch roller 16 facing each other are disposed in front of and above the separation roller 11 in the sheet supply path 14. A pair of register rollers 17 is disposed above the sheet dust removing roller 15 and the pinch roller 16.

The image forming section 5 includes a scanner unit 20, a process unit 21, a transfer unit 22, and a fixing unit 23.

The scanner unit 20 is disposed in an upper portion of the body casing 2. The scanner unit 20 includes a support plate 24 extending in the front-rear and right-left directions, and an exposure unit 25 fixed on the upper surface of the support plate 24.

The process unit 21 is disposed below the scanner unit 20 and above the sheet supply section 4. The process unit 21 includes a drum unit 26, as a tandem process unit, and four developing cartridges 27 for each color.

The drum unit 26 includes four drum sub units 28 serving as image carrier holder units for each color. That is, the drum sub units 28 include a yellow drum sub unit 28Y, a magenta drum sub unit 28M, a cyan drum sub unit 28C and a black drum sub unit 28K.

The drum sub units 28 are arranged in a row with some distance between adjacent drum sub units 28 in the front-rear direction. More specifically, the yellow drum sub unit 28Y, the magenta drum sub unit 28M, the cyan drum sub unit 28C, and the black drum sub unit 28K are arranged in this order from the front to the rear.

Figure 3:
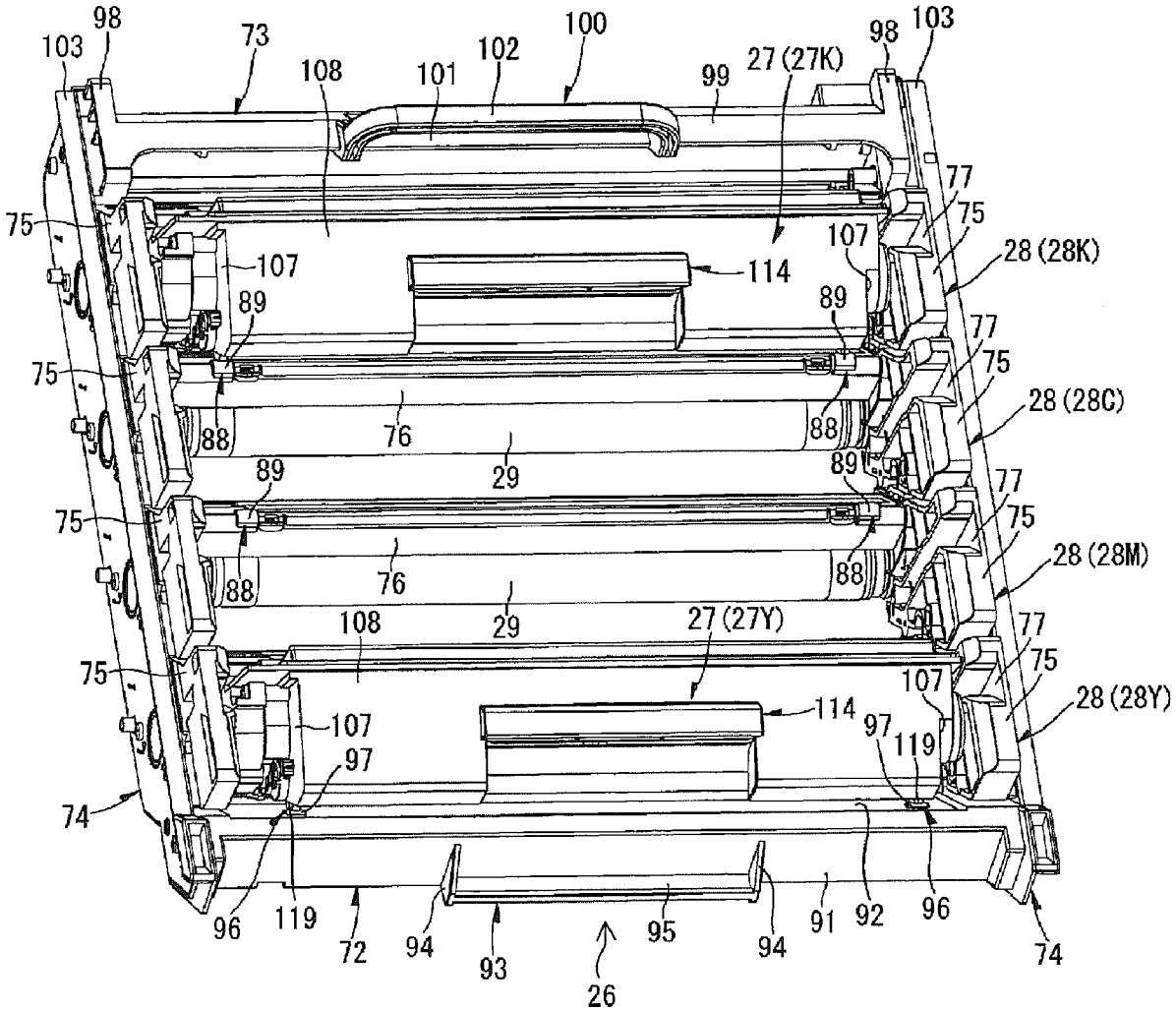
FIG. 3 is a perspective view of a drum unit shown in FIG. 1 viewed from an upper front left side, wherein two developing cartridges are removed from the drum unit.

Each drum sub unit 28 includes a center frame 76 disposed between a pair of side frames 75 as shown in FIG. 3. In FIG. 1, the side frames 75 are not shown for clarity.

Figure 2:
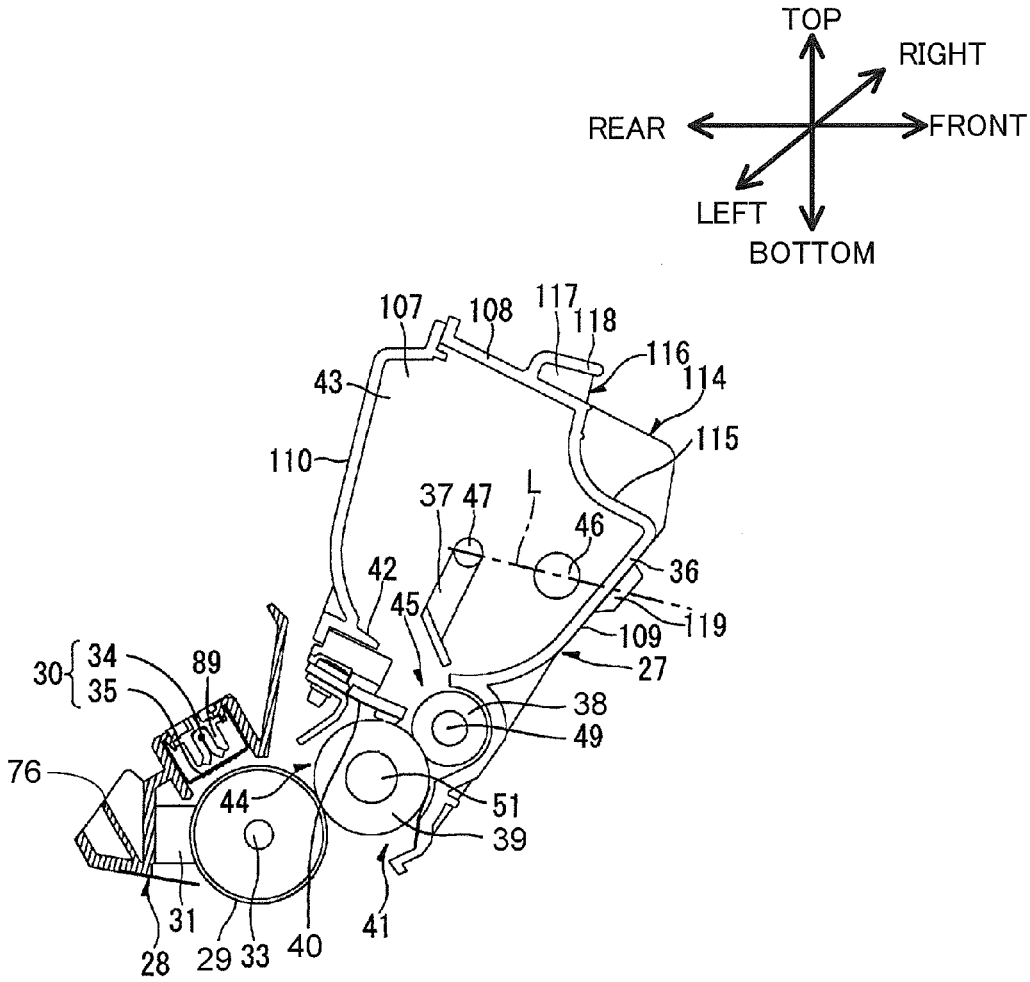
FIG. 2 is a sectional side view showing a developing cartridge and a drum sub unit shown in FIG. 1.

As shown in FIG. 2, each drum sub unit 28 holds a photosensitive drum 29, which functions as an image carrier, a scorotron charger 30, and a cleaning brush 31.

The photosensitive drum 29 extends along the right-left direction. The cylindrical photosensitive drum 29 is rotatably supported in the drum sub unit 28. The scorotron charger 30 is held by the center frame 76. The surface of the photosensitive drum 29 is uniformly charged by the charger 30 while the amount of charge applied to the photosensitive drum 29 is controlled. The cleaning brush 31 is held by the center frame 76. The cleaning brush 31 is disposed to remove paper dust or fibers on the photosensitive drum 29.

The four developing cartridges 27 are configured to be detachably mounted in the corresponding drum sub units 28 provided for each color, as shown in FIG. 1. That is, the developing cartridges 27 includes a yellow developing cartridge 27Y detachably mountable in the yellow drum sub unit 28Y, a magenta developing cartridge 27M detachably mountable in the magenta drum sub unit 28M, a cyan developing cartridge 27C detachably mountable in the cyan drum sub unit 28C, and a black developing cartridge 27K detachably mountable in the black drum sub unit 28K.

As shown in FIG. 2, each developing cartridge 27 includes a developing frame 36, and an agitator 37, a supply roller 38, a developing roller 39, as a developer carrier, and a layer thickness regulating blade 40 that are disposed in the developing frame 36.

The developing frame 36 is formed into a substantially box shape with an opening 41 formed at its lower end. The developing frame 36 is partitioned into a toner chamber 43, which serves as a developer container, and a developing chamber 44 by a partition wall 42 formed at a middle portion of the developing frame 36 in the vertical direction. The partition wall 42 is formed with a communication hole 45 that allows the toner chamber 43 and the developing chamber 44 to communicate with each other.

The yellow developing cartridge 27Y contains yellow toner, the magenta developing cartridge 27M contains magenta toner, the cyan developing cartridge 27C contains cyan toner, and the black developing cartridge 27K contains black toner. Each developing cartridge 27 contains, for example, positively chargeable non-magnetic single component polymerized toner.

The transfer unit 22 is disposed above the sheet supply section 4 and below the process unit 21 in the body casing 2, along the front-rear direction, as shown in FIG. 1. The transfer unit 22 includes a drive roller 56, a driven roller 57, a conveyor belt 58, transfer rollers 59, and a cleaning unit 60.

The sheet 3 supplied from the sheet supply section 4 is fed from the front to the rear by the conveyor belt 58 circulated by the drive roller 56 and the driven roller 57, so as to sequentially pass transfer positions between the conveyor belt 58 and the photosensitive drums 29 of the drum sub units 28. While the sheet 3 is being fed, each of the different colored toner images carried on the photosensitive drums 29 of the drum sub units 28 are sequentially transferred onto sheet 3. Thus, a multi-color image is formed on the sheet 3.

More specifically, when a yellow toner image carried on the photosensitive drum 29 of the yellow drum sub unit 28Y is transferred to the sheet 3, a magenta toner image formed on the photosensitive drum 29 of the magenta drum sub unit 28M is then transferred onto the sheet 3 having the yellow toner image transferred thereon. Similarly, a cyan toner image formed on the photosensitive drum 29 of the cyan drum sub unit 28C and a black toner image formed on the photosensitive drum 29 of the black drum sub unit 28K are transferred and laid on top of each other on the sheet 3. Thus, a multi-color image is formed on the sheet 3.

The fixing unit 23 is disposed behind the black drum sub unit 28K in the body casing 2 to face, in the front-rear direction, the transfer position between photosensitive drum 29 and the conveyor belt 58. The fixing unit 23 includes a heat roller 65 and a pressure roller 66.

The sheet 3 is fed to the fixing unit 23 where the color toner image transferred onto the sheet 3 is thermally fixed while the sheet 3 passes between the heat roller 65 and the pressure roller 66.

In the sheet ejection section 6, the sheet 3 is fed from the fixing unit 23 along a sheet ejection path 67 to a feed roller 69 and a pinch roller 70, and ejected by a pair of ejection rollers 71 onto a sheet ejection tray 68.

The drum unit 26 will be described in detail below.

As shown in FIG. 3, the drum unit 26 includes the four drum sub units 28 for the four colors, a front beam 72 and a rear beam 73, as beam members, which are disposed in front of the yellow drum sub unit 28Y and behind the black drum sub unit 28K, respectively, and a pair of side plates 74 that sandwich the front beam 72, the four drum sub units 28, and the rear beam 73 from each side in a width direction of the drum unit 26 (left-right direction in FIG. 3).

The four drum sub units 28, the front beam 72, the rear beam 73, and the pair of side plates 74 of the drum unit 26 are integrally and slidably installed in or removed from the drum accommodating space 7 in the body casing 2.

Each drum sub unit 28 includes a pair of side frames 75 disposed to face each other with some distance therebetween in the longitudinal direction of the drum sub unit 28 (i.e., width direction of the drum unit 26/right-left direction), and a center frame 76 disposed between the side frames 75.

Each side frame 75 is formed of a resin material into a substantially rectangle shape in side view. More specifically, each side frame 75 is formed into a substantially parallelogram shape with its upper end inclined forward and its lower end inclined rearward.

Each side frame 75 has a guide groove 77 formed on its inner surface. The guide grooves 77 are configured to guide the developing cartridges 27 into the corresponding drum sub unit 28.

The guide groove 77 is formed into a substantially U shape in a cross section, extending outward from the inner surface of the side frame 75 along the longitudinal direction of the drum sub unit 28. The guide groove 77 is formed on the inner surface of the side frame 75 so as to extend substantially vertically between the upper and lower ends of the side frame 75. The guide groove 77 includes a first guide portion 78 and a second guide portion 79. The first guide portion 78 guides the developing cartridge 27 while the cartridge 27 is being mounted in or removed from the drum sub unit 28. The second guide portion 79 guides the developing roller 39 when the cartridge 27 is installed in and removed from the drum sub unit 28 and the developing roller 39 rotates. The developing cartridge 27 is also configured to move slightly along the second guide portion 79 when the developing roller 39 is separated from the photosensitive drum 29 by a contact/separation mechanism 500 (described below with reference to FIG. 28).

Figure 11:
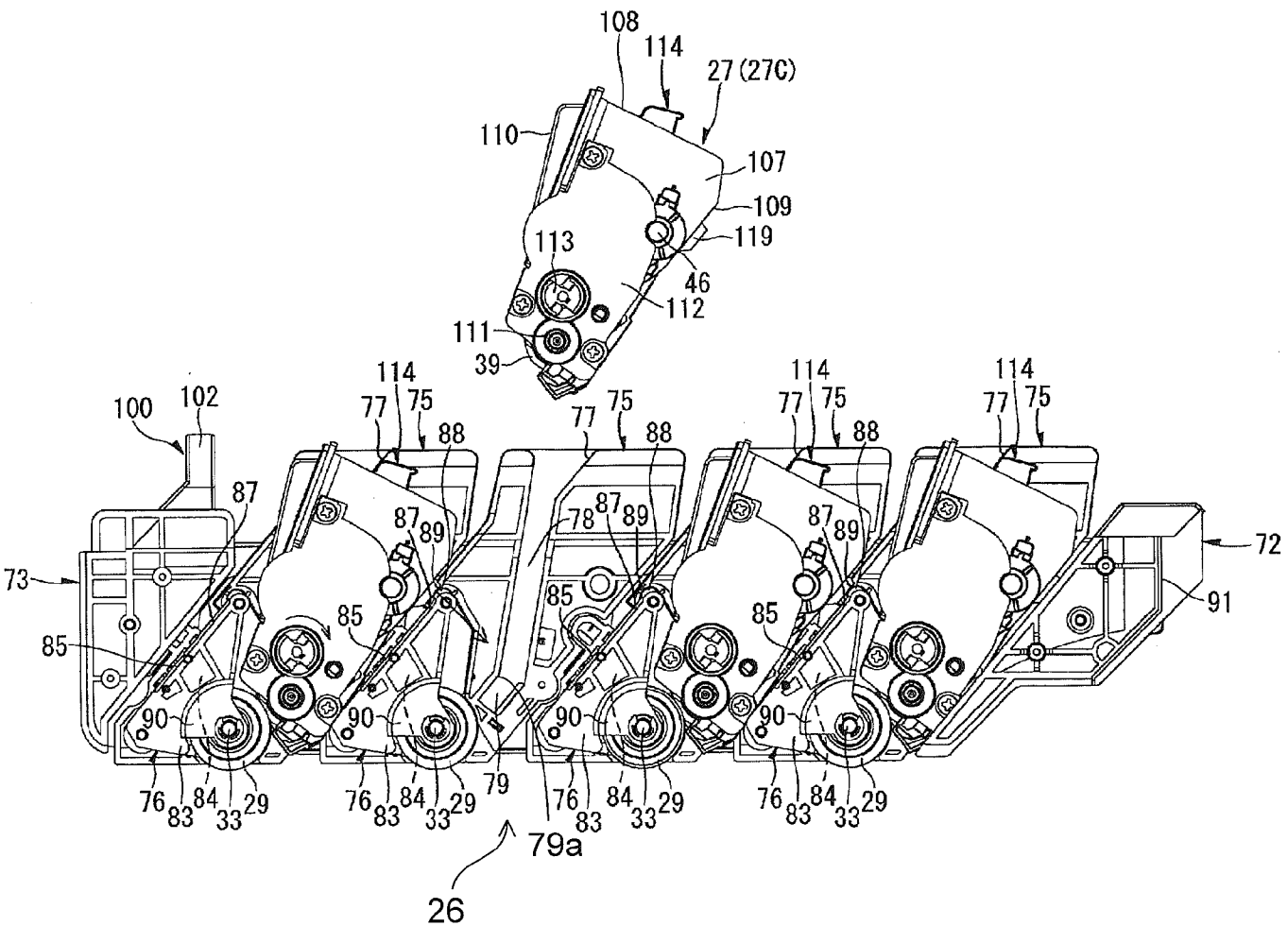
FIG. 11 is a left side view of the drum unit shown in FIG. 10.

More specifically, as shown in FIG. 11, the guide groove 77 is designed such that an upper front portion of the guide groove 77 is inclined rearward and gradually narrows in the front-rear direction. The first guide portion 78 is formed continuously downward from the upper portion of the guide groove 77 and extends substantially vertically. The second guide portion 79 is formed continuously from a lower portion of the first guide portion 78 and inclined substantially parallel to an upper surface 87 of a center plate 82 of the center frame 76. The bottom end of the second guide portion 79 is disposed at a position corresponding to a developing roller shaft 51 of the developing roller 39 that is brought into contact with the photosensitive drum 29 when the developing cartridge 27 is mounted in the drum sub unit 28. A collar member 111 (described below) of the developing cartridge 27 is slidably received in the guide groove 77.

Figure 8:
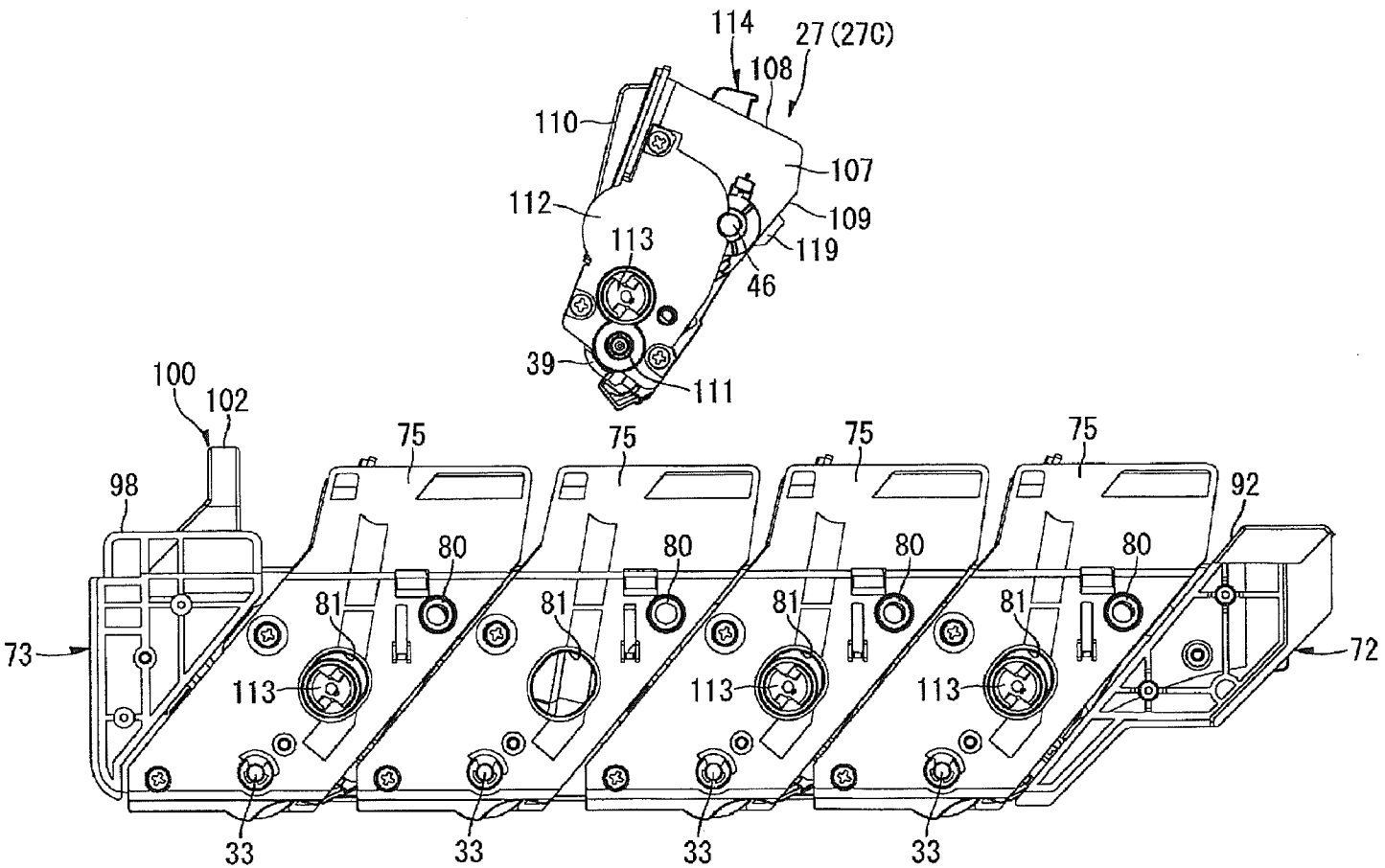
FIG. 8 is a left side view of the drum unit shown in FIG. 7.
Figure 9:
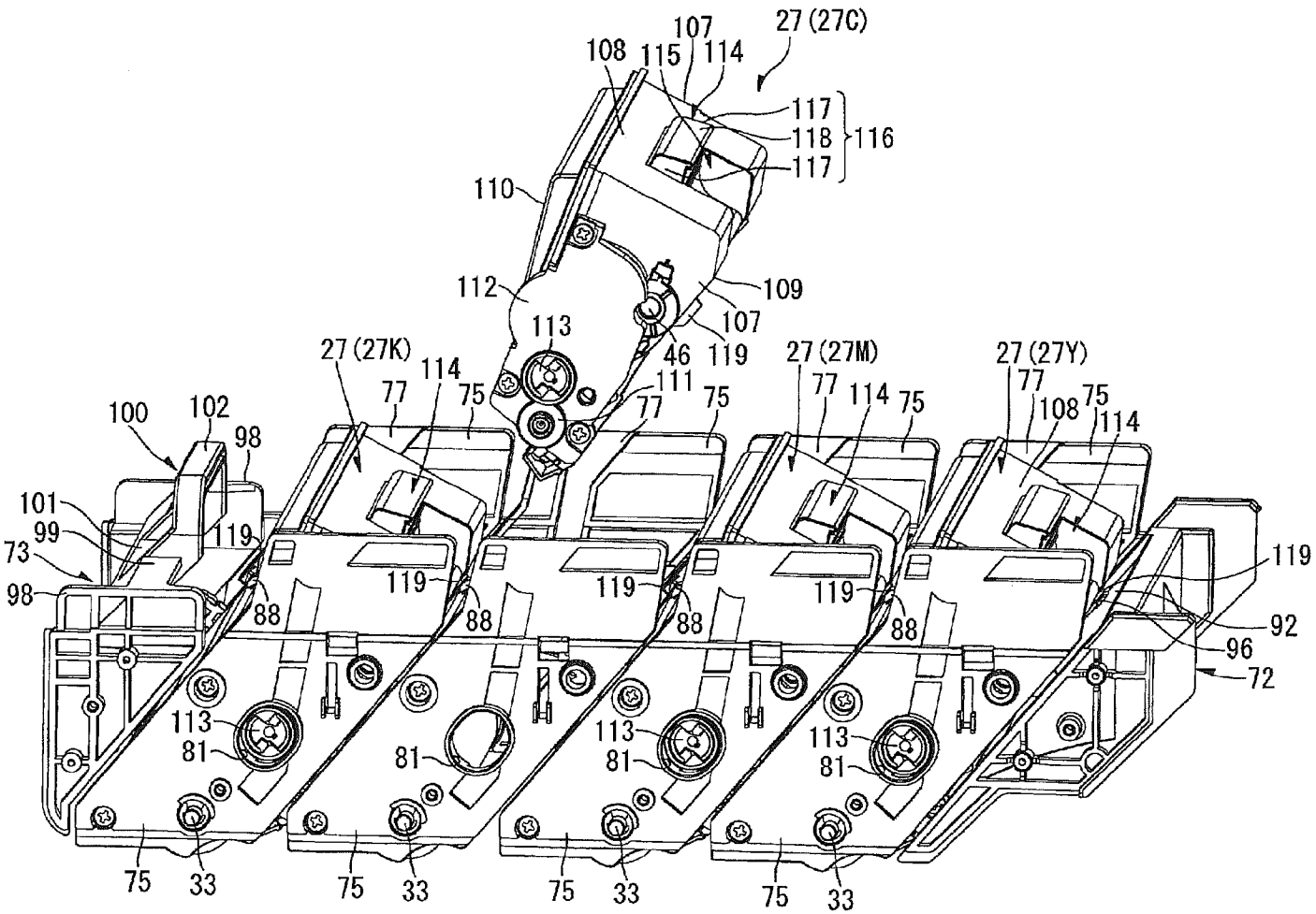
FIG. 9 is a perspective view of the drum unit shown in FIG. 7 viewed from an upper left side.
Figure 10:
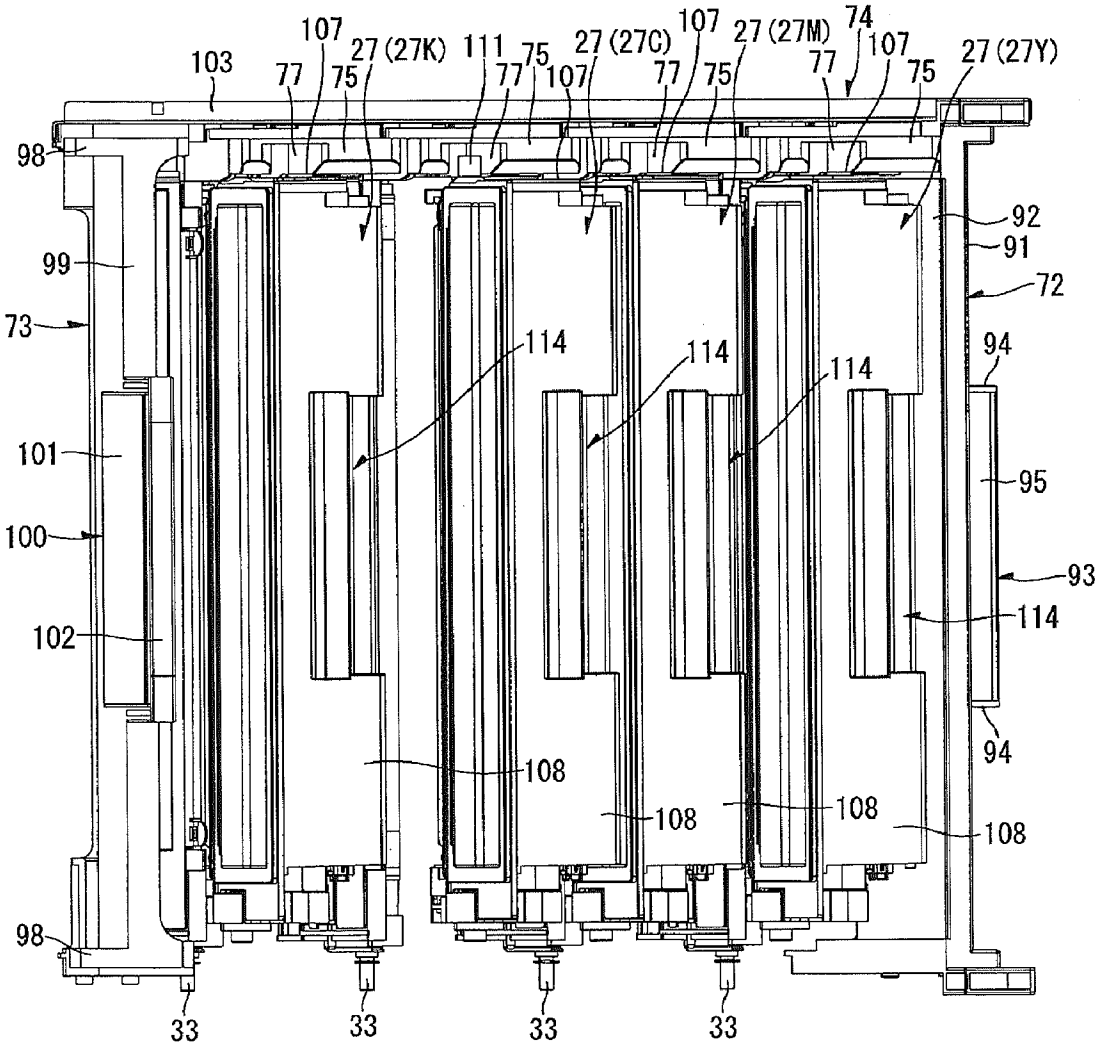
FIG. 10 is a plan view of the drum unit shown in FIG. 1, wherein a left side plate and a left side frame are removed from the drum unit and one developing cartridge is being removed therefrom.

As shown in FIG. 8, each side frame 75 has a tubular boss 80 formed in front of the guide groove 77. The boss 80 protrudes outwardly from an outer surface of the side frame 75 along the longitudinal direction of the drum sub unit 28. The boss 80 is disposed at a position corresponding to a window 46 of the developing cartridge 27 when the developing cartridge 27 is mounted in the drum sub unit 28.

Each left side frame 75 has a coupling inside insertion hole 81 formed at a middle portion of the guide groove 77 so as to correspond to a female coupling member 113 of the developing cartridge 27 when the cartridge 27 is mounted in the drum sub unit 28. The coupling inside insertion hole 81 passes through the left side frame 75 in its thickness direction. The coupling inside insertion hole 81 is of an elliptic shape which is slightly longer in a direction substantially parallel to the second guide portion 79 of the guide groove 77 (or the upper surface 87 of the center plate 82 of the center frame 76).

Each center frame 76 is made of a resin material and formed independently of the side frames 75. The center frame 76 includes a center plate 82 extending in a longitudinal direction thereof and a pair of side inner plates 83 provided on both sides of the center plate 82, as shown in FIGS. 11 and 12.

The center plate 82 has a substantially rectangular shape in a plan view, and the upper surface 87 is inclined from the upper front side toward the lower rear side. In the middle of the center plate 82 in the vertical direction, a charger holding portion 84 configured to hold the scorotron charger 30 is provided along the longitudinal direction of the center plate 82.

A charging wire 34 is disposed in the charger holding portion 84 along the longitudinal direction thereof, and a grid 35 (FIG. 2) is held under the charging wire 34, as shown in FIG. 2. The charger holding portion 84 is covered, from above, with a charger cover 85 extending along the upper surface 87 of the center plate 82.

Figure 12:
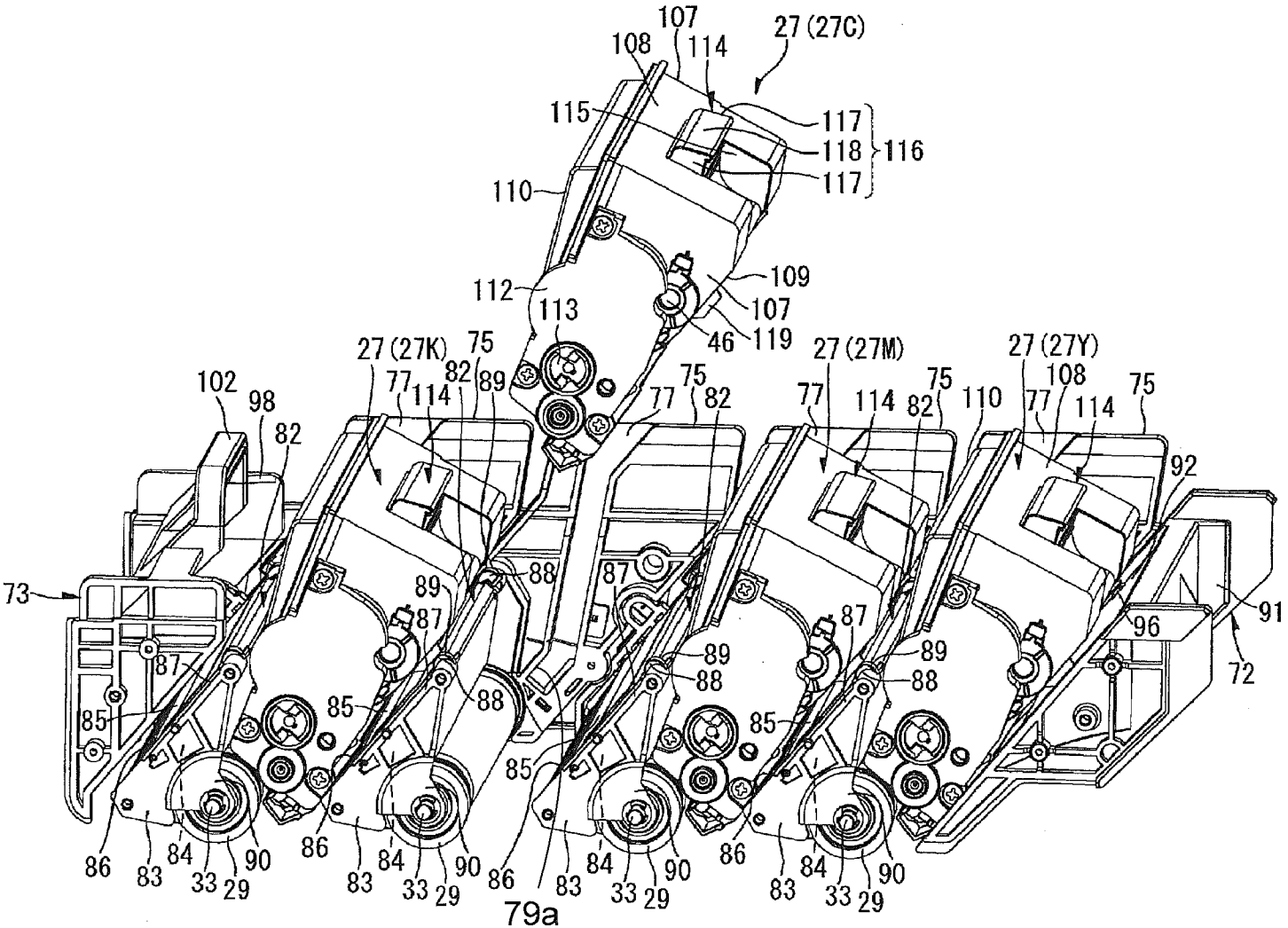
FIG. 12 is a perspective view of the drum unit shown in FIG. 10 viewed from an upper left side.

As shown in FIG. 12, the center plate 82 is provided with a brush holding portion 86 configured to hold the cleaning brush 31 (FIG. 2) below the charger holding portion 84. The cleaning brush 31 is held in the brush holding portion 86 along its longitudinal direction.

As shown in FIGS. 3 and 12, two support portions 88 for each drum sub unit 28 are disposed away from each other at upper end portions of the upper surface 87 of the center plate 82. Each support portion 88 is formed into a substantially semi-circular shape in a side view, protruding toward the corresponding developing cartridge 27. However, the drum sub unit 28Y does not include the support portions 88. A friction reduction tape 89 is affixed to a surface of each support portion 88. The friction reduction tape 89 serves to reduce friction and is made of a material having a lower frictional coefficient than a resin material of the center plate 82. When the developing cartridge 27 is mounted in the drum sub unit 28, protrusions 119 (described below) of the developing cartridge 27 (except for the yellow developing cartridge 27Y) are in contact with the support portions 88 via the friction reduction tape 89.

As shown in FIG. 12, the side inner plate 83 is formed so as to bend forwardly from each end of the center plate 82 in its longitudinal direction. As shown in FIG. 11, the side inner plate 83 has a substantially triangular shape which is narrower toward the front in the side view. A shaft insertion portion 90 configured to receive a drum shaft 33 is provided at the front end of the side inner plate 83.

Figure 4:
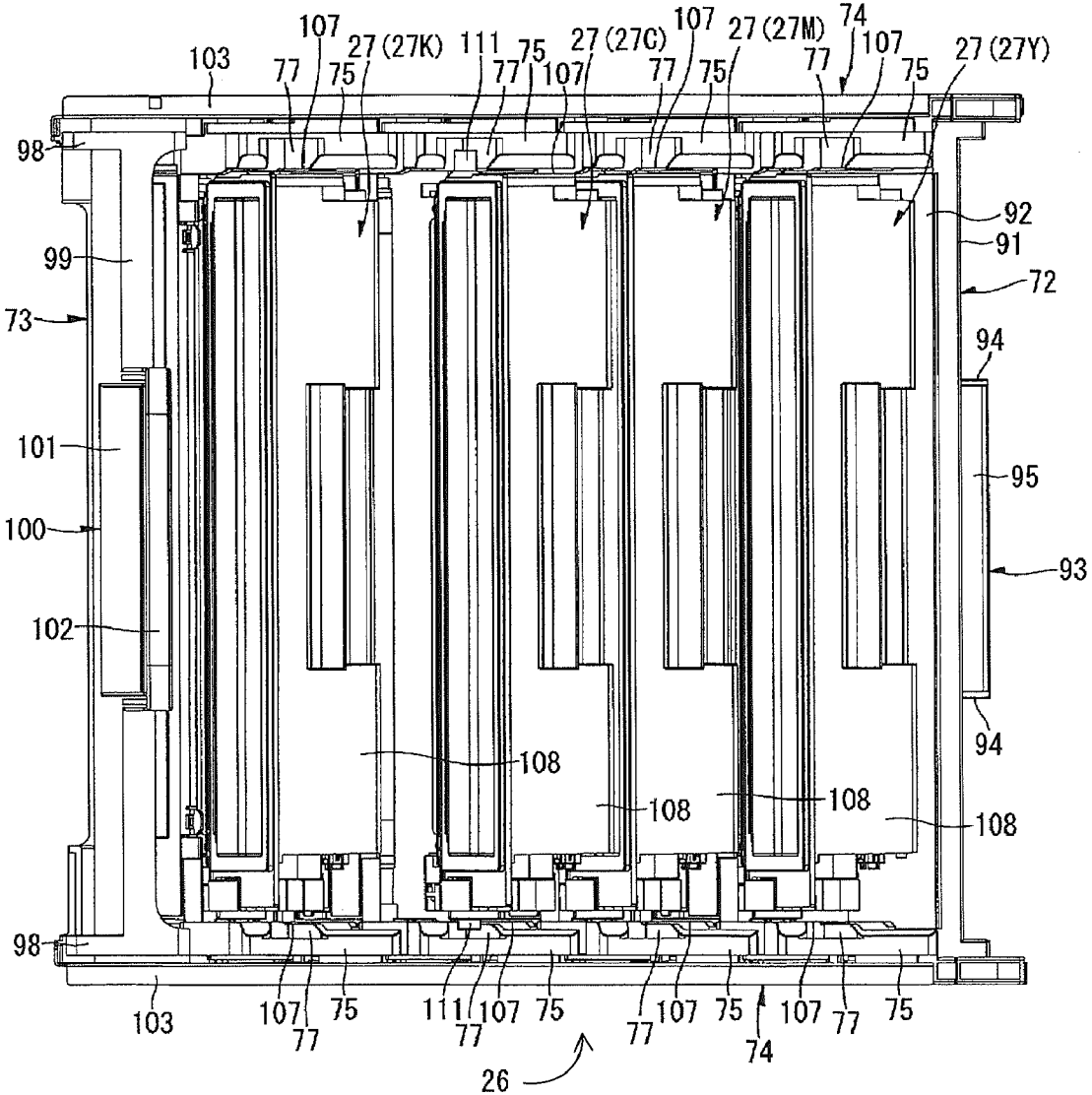
FIG. 4 is a plan view of the drum unit shown in FIG. 1, wherein one developing cartridge is being removed from the drum unit.

As shown in FIGS. 3 and 4, the front beam 72 is disposed in front of the yellow drum sub unit 28Y and between a pair of the side plates 74. The front beam 72 is made of a resin material and includes a front outer wall 91 facing outside of the drum unit 26, and a front inner wall 92 facing inside of the drum unit 26.

The front outer wall 91 has a substantially rectangular shape in a front view extending in a longitudinal direction of the front beam 72. The front outer wall 91 is provided with a front handle portion 93 at a middle of the front outer wall 91 in its longitudinal direction. The front handle portion 93 includes a pair of handle side plates 94 disposed to face each other with some distance therebetween in the longitudinal direction of the front outer wall 91, and a handle central plate 95 disposed between the handle side plates 94.

Each handle side plate 94 has a substantially triangular shape whose upper side extends forwardly and downwardly in a side view. Each handle side plate 94 protrudes frontward from the front face of the front outer wall 91.

The handle central plate 95 is disposed between the handle side plates 94 at their lower end portions, with a front end of the handle central plate 95 bent upward, forming an L-shape in a cross section.

The front inner wall 92 has a substantially rectangular shape in a rear view extending in the longitudinal direction of the front beam 72 and is disposed behind the front outer wall 91. The front inner wall 92 is inclined in a direction substantially parallel to the upper surface 87 of the center plate 82 of the center frame 76.

As shown in FIG. 3, two support portions 96 are disposed at upper end portions of the front inner wall 92 away from each other in the longitudinal direction of the front inner wall 92 to support the yellow developing cartridge 27Y. Each support portion 96 is formed into a substantially semi-circular shape in a side view, and protrudes toward the yellow developing cartridge 27Y when the yellow developing cartridge 27Y is mounted in the yellow drum sub unit 28Y. A friction reduction tape 97 is affixed to a surface of each support portion 96. The friction reduction tape 97 serves to reduce friction and is made of a material having a lower frictional coefficient than a resin material of the front beam 72. When the yellow developing cartridge 27Y is mounted in the yellow drum sub unit 28Y, protrusions 119 contact the support portions 96 via the friction reduction tape 97.

As shown in FIGS. 3 and 4, the rear beam 73 is disposed behind the black drum sub unit 28K and between a pair of side plates 74. The rear beam 73 is made of a resin material and includes a pair of rear sidewalls 98 disposed to face each other in the longitudinal direction of the rear beam 73, a rear bridge portion 99 disposed between the rear sidewalls 98, and a rear handle portion 100 protruding upward from the rear bridge portion 99.

The rear handle portion 100 includes a recessed portion 101 that is recessed downwardly from an upper end of the rear bridge portion 99 so as to form a substantially U-shape in a rear view, and a rear handle 102 of a substantially U-shape in a rear view that is connected to the upper end of the rear bridge portion 99 across the recessed portion 101 in the longitudinal direction of the rear beam 73.

As shown in FIGS. 3 and 4, the side plates 74 are provided in pairs to sandwich the front beam 72, the four drum sub units 28, and the rear beam 73 from each end in the longitudinal direction thereof. Each side plate 74 is made of a material, such as metal and fiber reinforced resin, having a lower linear coefficient of expansion than a resin material of the drum sub units 28. Each side plate 74 may be made of metal.

Each side plate 74 is formed into a substantially rectangular shape in a side view extending in the front-rear direction, so as to face the front beam 72 at its front end and the rear beam 73 at its rear end.

Each side plate 74 is formed with a flanged portion 103, which is bent outward from an upper end the side plate 74 so as to extend along the front-rear direction. The flanged portion 103 is slidably engaged in a rail (not shown) provided in the body casing 2.

Figure 5:
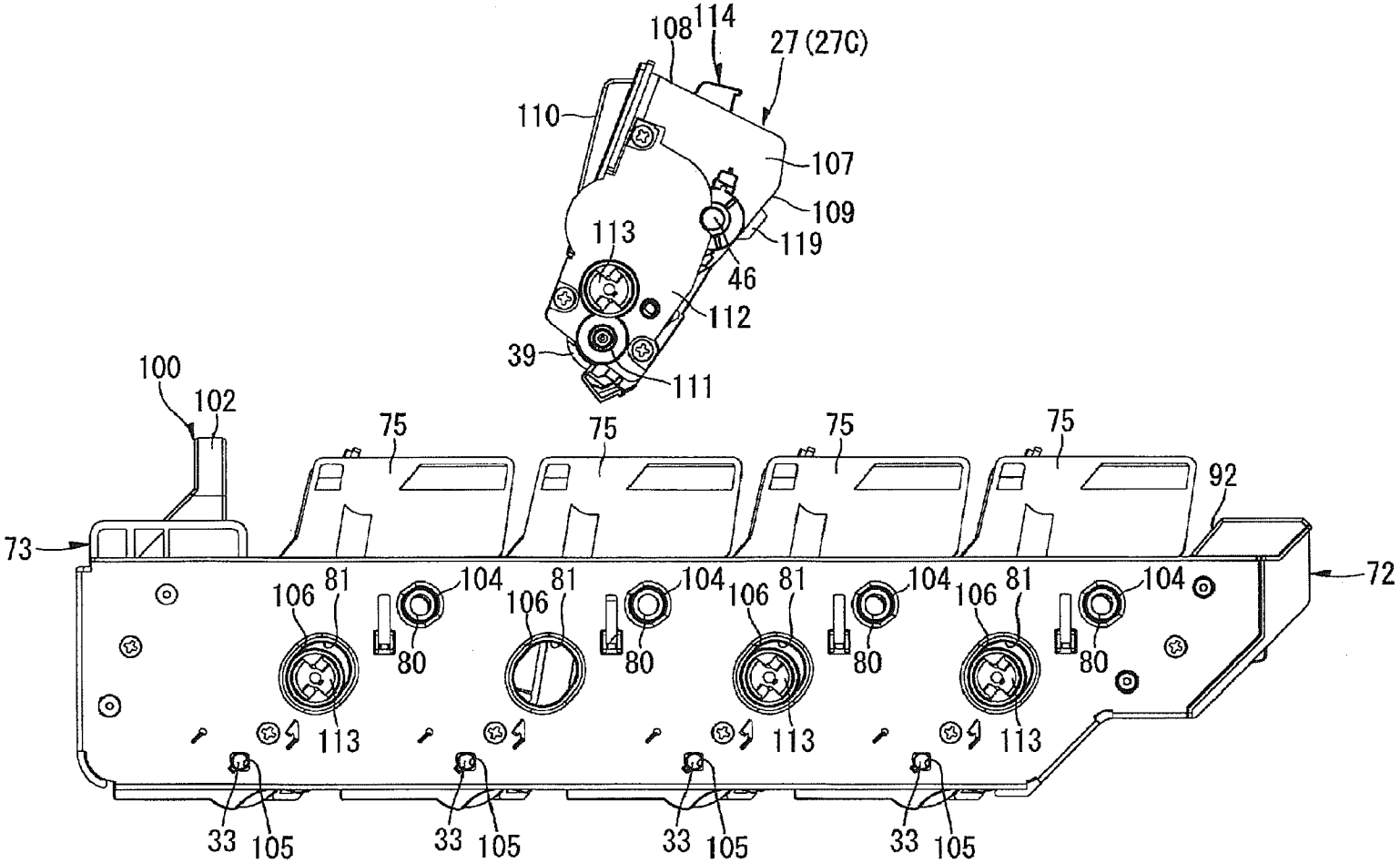
FIG. 5 is a left side view of the drum unit shown in FIG. 4.

As shown in FIG. 5, each of the side plates 74 is formed with four light transmission holes 104. When the side plates 74 are assembled to the drum sub units 28, each of the four light transmission holes 104 receives the boss 80 of the respective drum sub unit 28.

The light transmission holes 104 are formed at upper portions of the side plate 74 along the front-rear direction. More specifically, the four light transmission holes 104 are formed into a round shape through the side plate 74 in its thickness direction at positions facing the windows 46 of the developing cartridges 27 and the bosses 80 of the drum sub units 28 when the developing cartridges 27 are mounted in the drum unit 26.

Each side plate 74 is formed at its lower portions with four shaft holes 105, which are arranged 105 along the front-rear direction. Each shaft hole 105 is configured to receive an end of the drum shaft 33 when the side plates 74 are coupled to the drum sub units 28. The shaft holes 105 are formed into a substantially square shape through each side plate 74 in its thickness direction at positions corresponding to the ends of the drum shafts 33.

Figure 6:
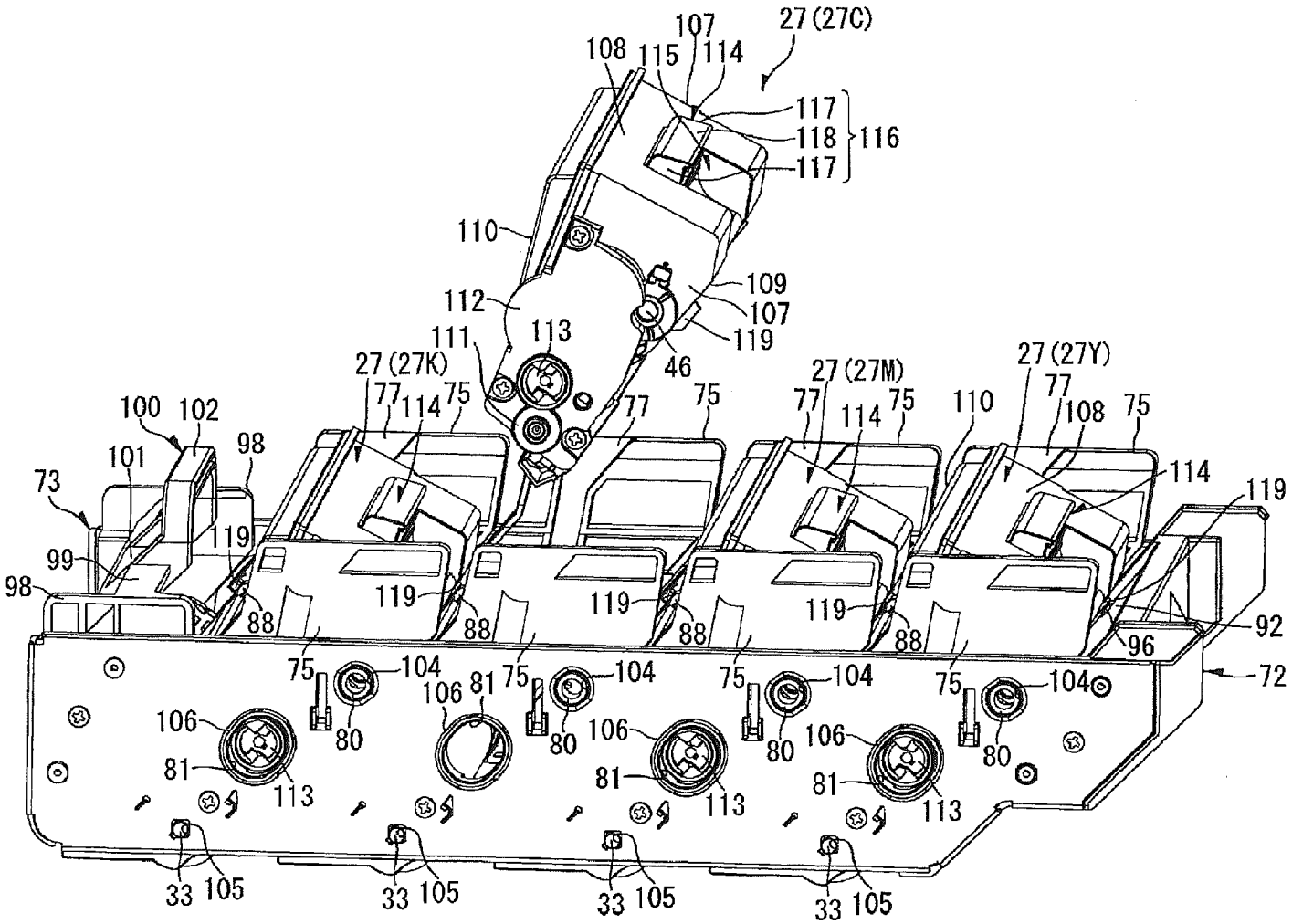
FIG. 6 is a perspective view of the drum unit shown in FIG. 4 viewed from an upper left side.
Figure 7:
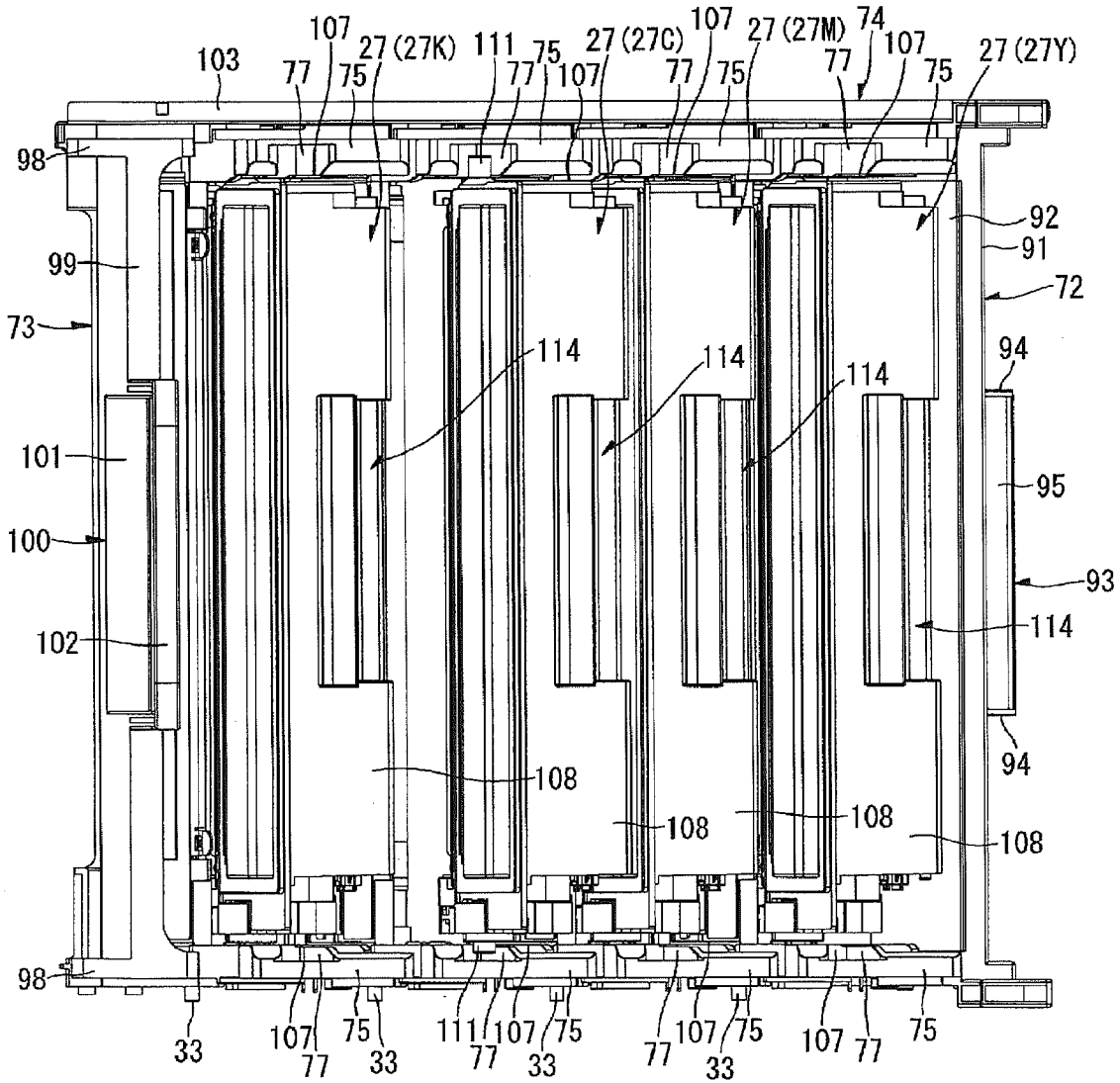
FIG. 7 is a plan view of the drum unit shown in FIG. 1, wherein a left side plate is removed from the drum unit and one developing cartridge is being removed therefrom.

As shown in FIGS. 5 and 6, the left side plate 74 is formed with four coupling outside insertion holes 106, which are provided along the front-rear direction at a middle portion in the vertical direction. The coupling outside insertion holes 106 are formed so as to face the female coupling members 113 of the developing cartridges 27 when the developing cartridges 27 are mounted in the drum unit 26. The coupling outside insertion holes 106 are formed through the left side plate 74 in its thickness direction at positions corresponding to the coupling inside insertion holes 81 formed in the left side frames 75. The coupling outside insertion holes 106 are formed in an elliptic shape which is slightly longer in a direction of movement of the developing cartridge 27 along the second guide portion 79, the direction being substantially parallel to the front inner wall 92.

With such a structure, ends of the drum shaft 33, which is supported between the side frames 75 of each drum sub unit 28, are inserted into the shaft holes 105 of the side plates 74. The coupling outside insertion holes 106, which are formed in the left side plate 74, face the coupling inside insertion holes 81 of the left side frames 75 of the drum sub units 28. The female coupling members 113 of the developing cartridges 27 face both the coupling inside insertion holes 81 and the coupling outside insertion holes 106 when the developing cartridges 27 are mounted in the drum unit 26.

The developing cartridges 27 will be described in detail below.

As shown in FIGS. 2 and 6, the developing frame 36 of each developing cartridge 27 is integrally provided with a pair of sidewalls 107, a top wall 108 disposed between the sidewalls 107 at their top ends, a front wall 109 disposed between the sidewalls 107 at their front ends, and a rear wall 110 disposed between the sidewalls 107 at their rear ends. The sidewalls 107, the front wall 109, and the rear wall 110 define, at their bottom ends, the opening 41 from which the developing roller 39 is exposed.

The developing roller shaft 51 of the developing roller 39 is rotatably supported by the sidewalls 107 of the developing frame 36. Each end of the developing roller shaft 51 in the axial direction protrudes outward from one of the sidewalls 107 of the developing frame 36. The end of the developing roller shaft 51 in the axial direction is covered with the conductive collar member 111, as shown in FIG. 4.

Figure 13:
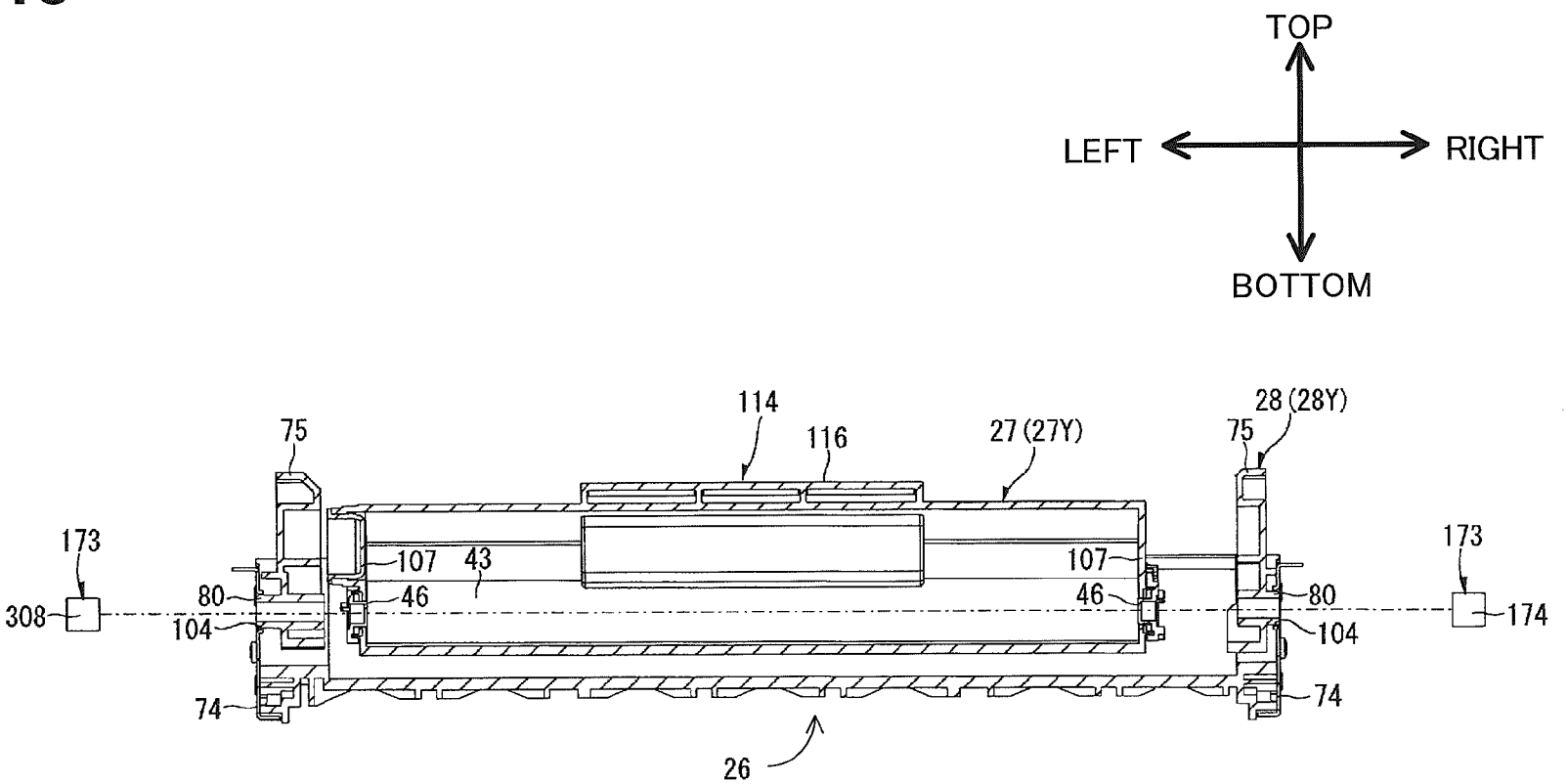
FIG. 13 is a sectional view of the drum unit shown in FIG. 1, taken along a vertical line and viewed from a front side.

As shown in FIG. 2, both sidewalls 107 are formed with the windows 46 for detecting the amount of toner stored in the toner chamber 43. As shown in FIG. 13, the windows 46 are disposed opposite to each other across the toner chamber 43. The windows 46 allow light to pass therethrough from a light emitting device 174 to a photoreceptor 308 along the longitudinal direction of the developing cartridge 27. As shown in FIG. 2, the window 46 formed in each sidewall 107 is disposed on a line L passing through a rotation shaft 47 of the agitator 37 and the protrusion 119. The distance between the protrusion 119 and the window 46 is shorter than the distance between the rotation shaft 47 and the window 46.

As shown in FIGS. 5 and 6, the left sidewall 107 is provided with a gear mechanism (not shown) covered with a gear cover 112. The gear mechanism includes the coupling female member 113 exposed from the gear cover 112, and a gear train (not shown) engaged with the coupling female member 113.

A coupling male member 153 (FIG. 19) provided in the body casing 2 is received in the coupling female member 113 so as to advance or retract and rotate together with the coupling female member 113. The coupling male member 153 receives a drive force from a motor 154 (FIG. 19) provided in the body casing 2.

The gear train (not shown) includes an agitator drive gear fixed to the rotation shaft 47 of the agitator 37, a supply roller drive gear fixed to a supply roller shaft 49 of the supply roller 38, and a developing roller drive gear fixed to the developing roller shaft 51 of the developing roller 39, which are engaged with the coupling female member 113 via, for example, an intermediate gear.

As shown in FIGS. 5 and 6, the top wall 108 is provided with a developing cartridge holding portion 114. The developing cartridge holding portion 114 is disposed in a middle of the top wall 108 in its longitudinal direction, and includes a recessed portion 115 that is recessed downwardly from the top wall 108 of the developing frame 36, and a handle 116 provided at a rear end of the recessed portion 115.

As shown in FIG. 6, the recessed portion 115 is formed in a substantially rectangular shape in a plan view, such that its front end is cut out so as to open toward an adjacent front developing cartridge 27 when the developing cartridges 27 are mounted in the drum unit 26.

The handle 116 is disposed at the rear end of the recessed portion 115 so as to extend in the longitudinal direction of the top wall 108. The handle 116 includes handle side plates 117 that interpose the recessed portion 115 therebetween, and a handle center wall 118 disposed between the side plates 117.

Each of the handle side plates 117 is formed in a substantially triangular shape which becomes narrower toward the rear side in a side view, so as to extend upwardly from each end of the recessed portion 115 in the longitudinal direction of the top wall 108. The handle center wall 118 is disposed between the side plates 117 at their upper ends. With such a structure, the handle 116 is configured to be pulled upward by inserting fingers into the recessed portion 115 from the front side to contact an inner surface of the handle center wall 118.

As shown in FIGS. 2 and 3, the front wall 109 includes two protrusions 119 serving as supported portions spaced away from each other in the longitudinal direction of the developing cartridge 27. Each protrusion 119 is disposed on a line L passing through the window 46 and the rotation shaft 47 of the agitator 37 in a side view. Each protrusion 119 protrudes frontward from the front wall 109 and is a substantially trapezoidal shape in a side view, as shown in FIG. 5.

Installation of the developing cartridges 27 in the drum unit 26 will be described in detail below.

The developing cartridge 27 for each color is inserted by an operator into the corresponding drum sub unit 28 of the drum unit 26 from above.

More specifically, the collar members 111 covering both ends of the developing roller 51 of the developing cartridge 27 are inserted into guide grooves 77 formed in the side frames 75 of the drum sub unit 28 and are slidably moved down along the grooves 77, so that the developing cartridge 27 can be pushed down in the drum sub unit 28. When the collar members 111 at both ends of the developing roller shaft 51 are brought into contact with the deepest ends of the guide grooves 77, the developing cartridge 27 is prevented from being further pushed downward and the developing roller 39 contacts the photosensitive drum 29.

Then, as the operator releases the developing cartridge 27, the developing cartridge 27 tilts or pivots about the developing roller shaft 51 (the collar members 111) under its own weight, such that the upper end of the developing cartridge 27 is moved frontward against the adjacent center frame 76 or the front beam 72 disposed in front of the inserted developing cartridge 27. Thus, the protrusions 119 formed in the front wall 109 of the developing frame 36 are brought into contact with and supported by the support portions 88 of the center frame 76 or the support portions 96 of the front beam 72. When the developing cartridge 27 tilts or is pivotally moved, the collar members 111 are brought into contact with rear walls 79*a* (in FIG. 11) of the second guide portions 79 of the guide grooves 77. Thus, the developing cartridge 27 is placed in position in the drum sub unit 28, and installation into the drum sub unit 28 is completed.

When the developing cartridge 27 is installed in the corresponding drum sub unit 28, the left-side window 46, as shown in FIG. 13, embedded in the left sidewall 107 of the developing frame 36 faces, in the longitudinal direction of the developing cartridge 27, the boss 80 formed in the left side frame 75 and the light transmission hole 104 formed in the left side plate 74. Similarly, the right-side window 46 embedded in the right sidewall 107 of the developing frame 36 faces, in the longitudinal direction of the developing cartridge 27, the boss 80 formed in the right side frame 75 and the light transmission hole 104 formed in the right side plate 74. In the body casing 2, an optical sensor 173 for detecting the amount of toner stored in the toner chamber 43 is provided for each developing cartridge 27. The optical sensor 173 includes the light emitting device 174 and the photoreceptor 308. With the developing cartridge 27 set in the drum sub unit 28, light emitted from the light emitting device 174 of the optical sensor 173 can be received by the photoreceptor 308, through the right-side light transmission hole 104, the right-side boss 80, the right-side window 46, the toner chamber 43, the left-side window 46, the left-side boss 80, and the left-side light transmission hole 104, in this order.

As shown in FIG. 5, the coupling female member 113 exposed from the gear cover 112 provided on the left sidewall 107 of the developing frame 36 is disposed so as to face, in the longitudinal direction of the developing cartridge 27, the coupling inside insertion hole 81 formed in the left side frame 75 and the coupling outside insertion hole 106 formed in the left side plate 74. With such a structure, the coupling male member 153, which will be described in detail below, can be inserted into or retracted from the coupling female member 113, via the coupling outside insertion hole 106 and the coupling inside insertion hole 81. With the coupling male member 153 coupled to the coupling female member 113, a drive force from the motor 154 (FIG. 19) is inputted to the coupling female member 113 via the coupling male member 153, so that the agitator 37, the supply roller 38, and the developing roller 39 can be driven. At this time, a moment of rotation about the coupling female member 113 is applied to the developing cartridge 27. The direction of the moment of rotation applied to the developing cartridge 27 is substantially parallel to the direction that each protrusion 119 applies force to the support portions 88, 96 due to the weight of the developing cartridge 27. Thus, by the moment of rotation applied to the developing cartridge 27, the protrusions 119 can further be pressed against the support portions 88, 96 and the collar members 111 can further be pressed against the rear walls 79*a* of the second guide portions 79 of the guide grooves 77. Thus, the developing cartridge 27 can be firmly pressed against the drum sub unit 28 and placed in position in the drum sub unit 28.

A pressing mechanism 120 will be described in detail below.

Figure 14:
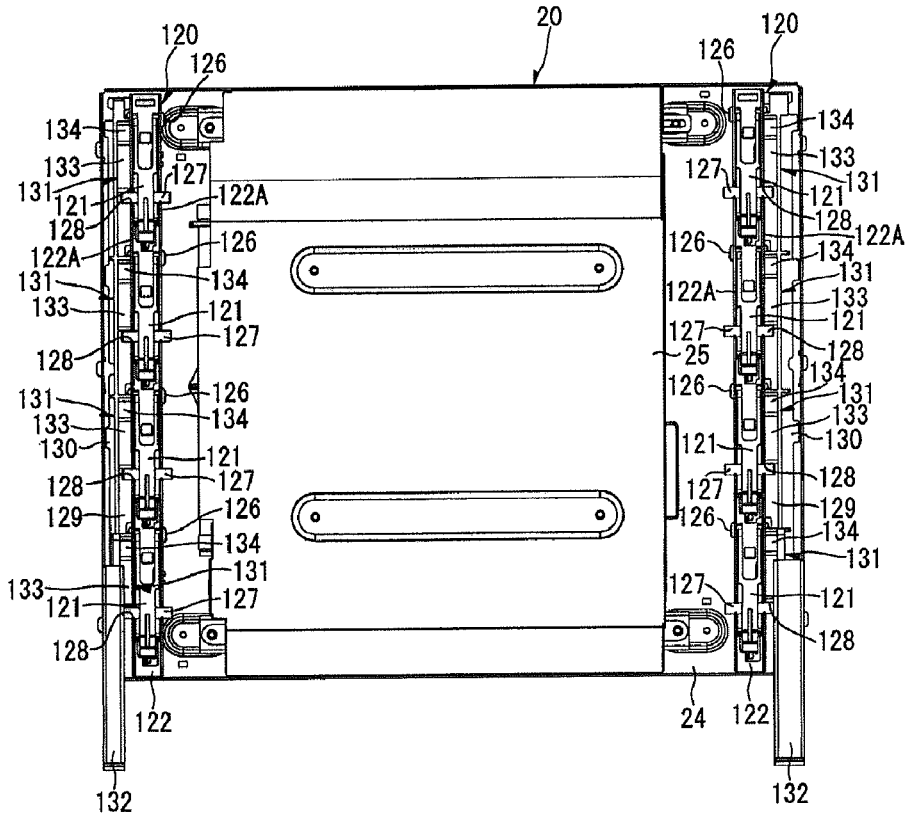
FIG. 14 is a plan view of a scanner section shown in FIG. 1.
Figure 15:
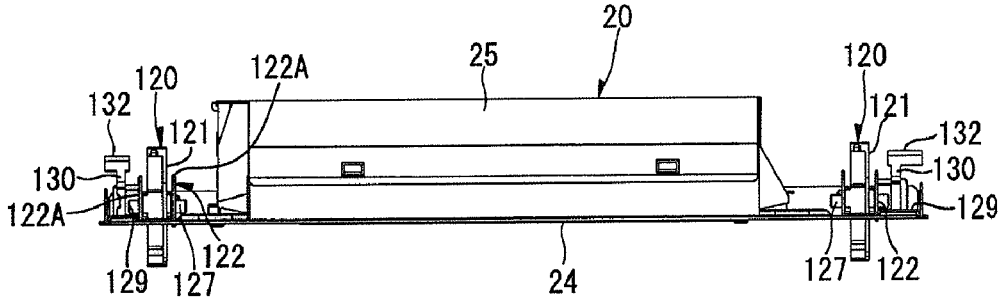
FIG. 15 is a front view of the scanner section shown in FIG. 14.

The color laser printer 1 includes a pair of pressing mechanisms 120, as shown in FIGS. 14 and 15, configured to press the developing cartridges 27 in a direction in which the developing rollers 39 contact the corresponding photosensitive drums 29 when the developing cartridges 27 are set in the corresponding drum sub units 28 of the drum unit 26.

A pair of pressing mechanisms 120 is disposed opposite to each other across the exposure unit 25 of the scanner unit 20 in the width direction of the scanner unit 20 (right and left direction in FIGS. 14 and 15). The pressing mechanisms 120 are supported by the support plate 24 of the scanner unit 20. In other words, the pressing mechanism 120 is disposed at each end of the support plate 24 of the scanner unit 20 in its width direction, so as to interpose the exposure unit 25 between the pressing mechanisms 120.

Figure 16:
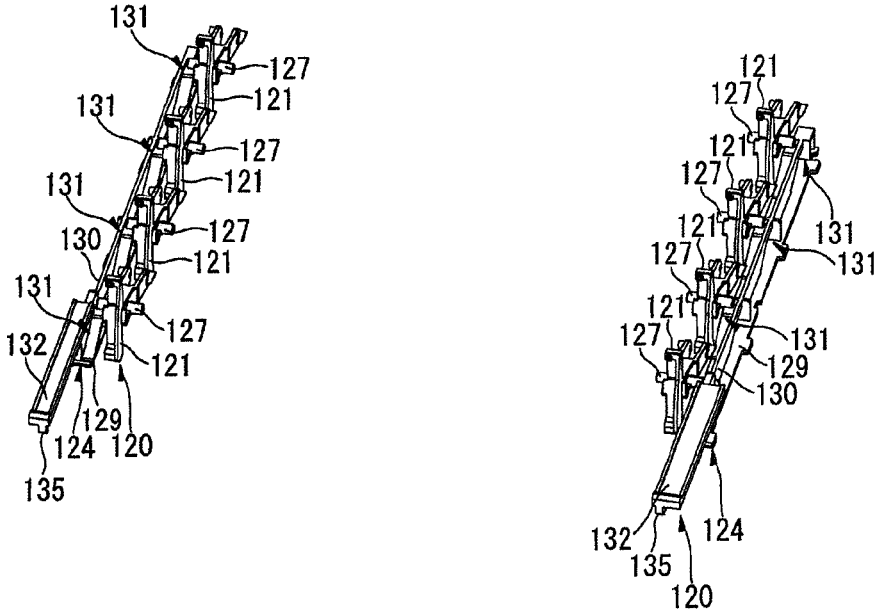
FIG. 16 is a perspective view of pressing mechanisms shown in FIG. 14 viewed from an upper front right side.
Figure 17:
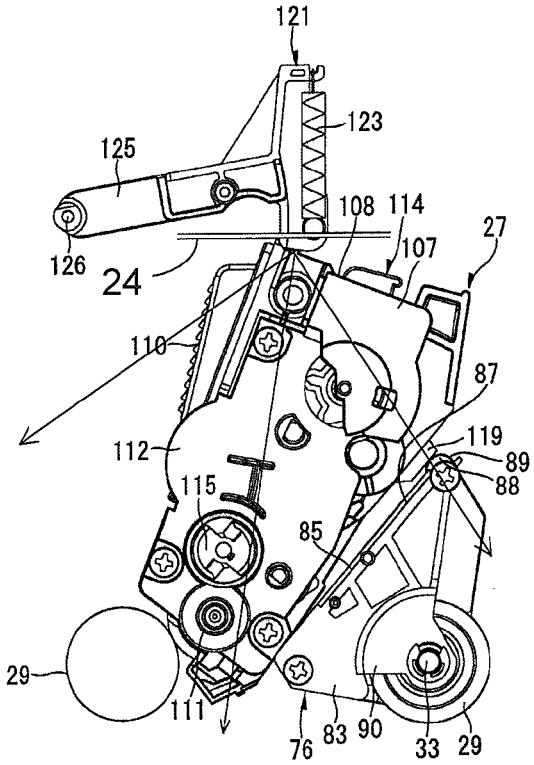
FIG. 17 is a side view of the developing cartridge pressed by the pressing mechanism shown in FIG. 16.

As shown in FIGS. 14-18, the pressing mechanisms 120 are provided, in association with the developing cartridges 27, with pressing members 121, holding members 122, coil springs 123, and first linear cams 124. The pressing members 121 are movable between a pressing position to press the developing cartridges 27 and a separation position to separate from the developing cartridges 27. The holding members 122 are fixed on the upper surface of the support plate 24 of the scanner unit 20 and are formed into a substantially upwardly-open "U" shape in a cross section. The coil springs 123 urge the corresponding pressing members 121 toward the pressing position, as shown in FIG. 17. The first linear cams 124 are configured to move the pressing mechanisms 120 in synchronization with each other.

Figure 18:
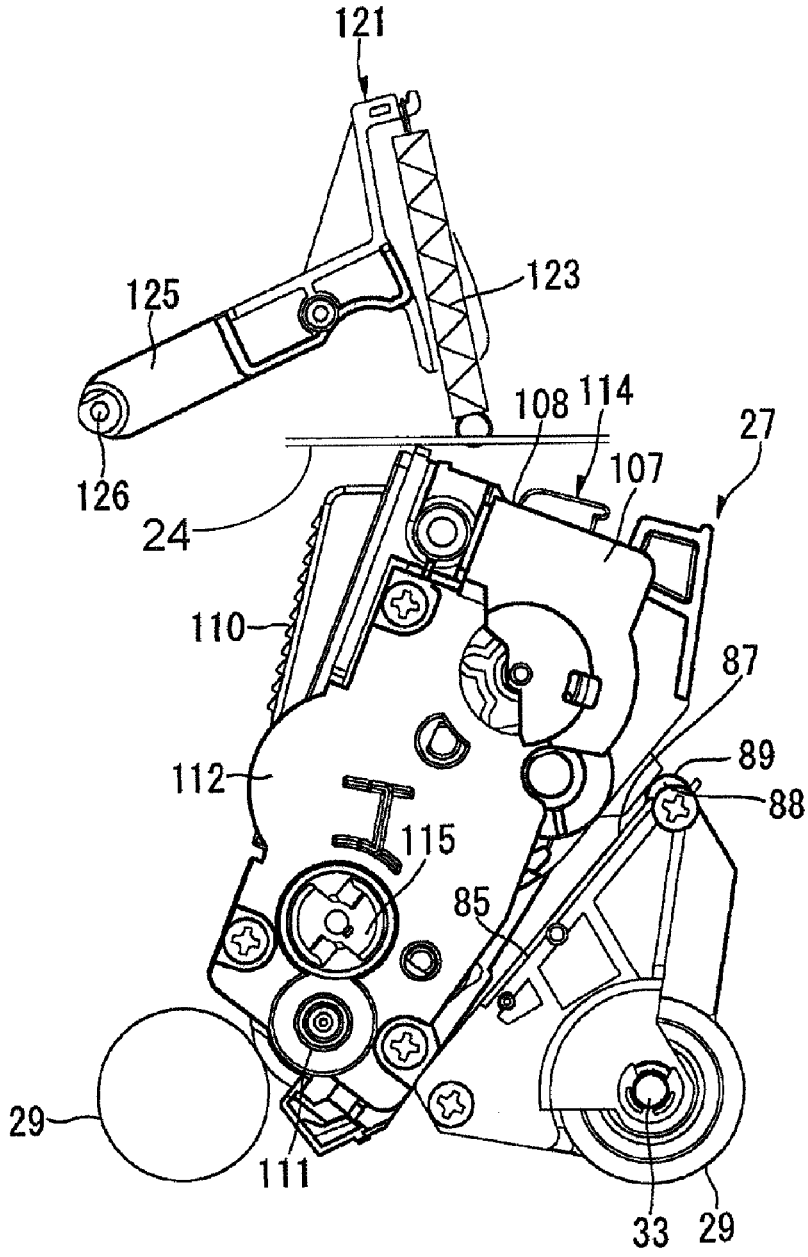
FIG. 18 is a side view of the developing cartridge separated from the pressing mechanism shown in FIG. 16.

Each pressing member 121 is formed in a substantially rectangular shape in a side view, as shown in FIGS. 17 and 18. The pressing member 121 is integrally formed with a support arm 125 extending rearward from a central portion of the pressing member 121 in its longitudinal direction. The pressing member 121 is disposed between side plates 122A of the holding member 122 as shown in FIG. 15, and a rear end of the support arm 125 is pivotally supported about a support shaft 126 disposed between the side plates 122A. The pressing member 121 is integrally formed with a guide shaft 127 extending from a central portion of each side of the pressing member 121 in its longitudinal direction along its thickness direction (width direction of the scanner 20/right and left directions in FIGS. 14-16).

Figure 26:
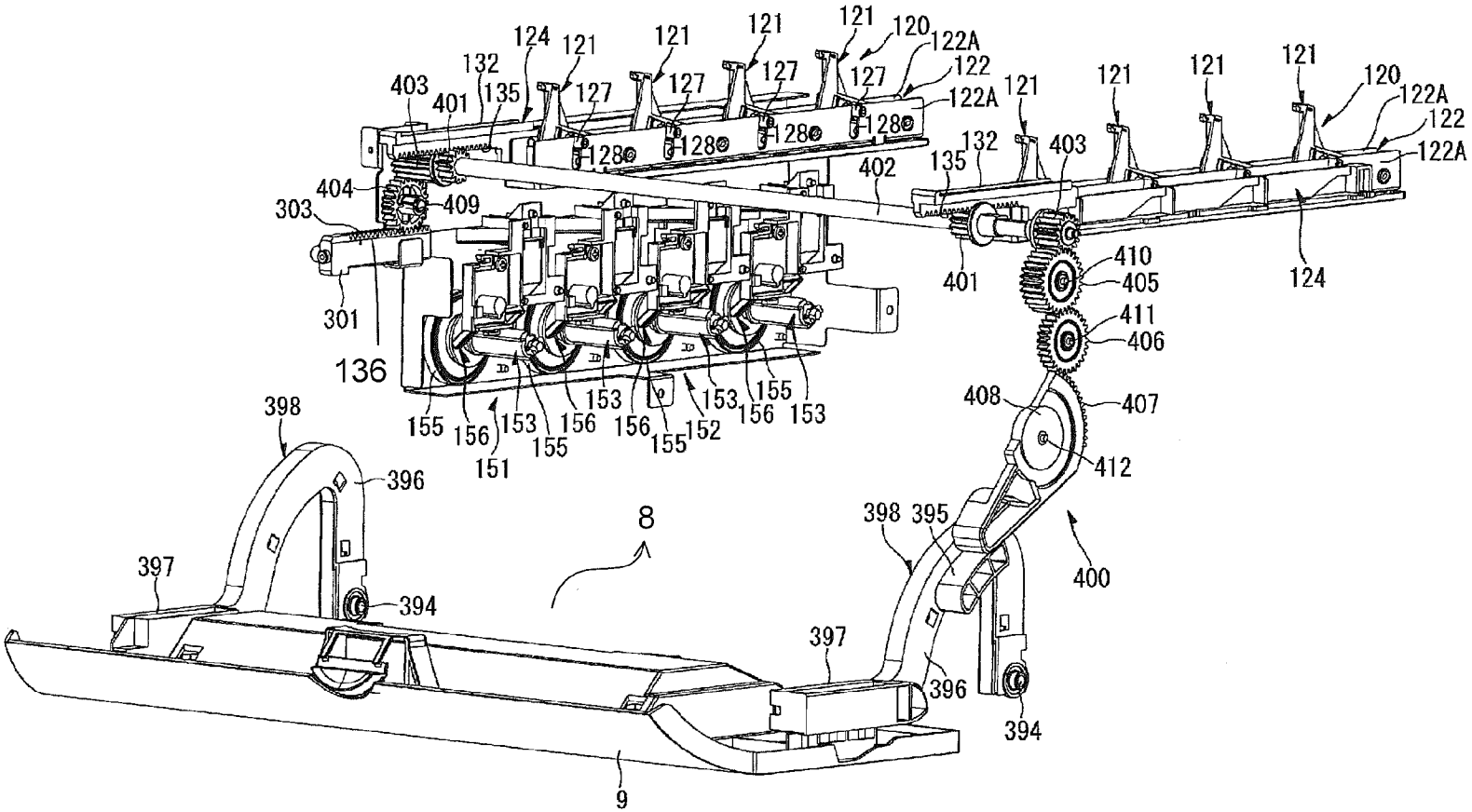
FIG. 26 is a perspective view of the pressing mechanisms, the drive force transmission unit, and an interlocking mechanism provided in the laser printer shown in FIG. 1 viewed from a front right side when the front cover is open.

The side plates 122A in FIG. 14 of the holding member 122 are formed with substantially U-shaped grooves 128, as will be best seen in FIG. 26, extending downward from upper edges of the side plates 122A. Each side plate 122A has four grooves 128 spaced away from each other in the front-rear direction. Each end of the guide shaft 127 of the pressing member 121 fit in the relevant grooves 128.

An end of the coil spring 123 is hooked to an upper end of the pressing member 121, as shown in FIGS. 17 and 18, and the other end of the coil spring 123 is fixed in the holding member 122.

The first linear cams 124 are disposed outside the holding members 122 in the width direction of the scanner unit 20 (right and left direction in FIG. 14-16), so as to linearly move in the front-rear direction. As shown in FIGS. 14 and 16, each first linear cam 124 is integrally provided with a base plate 129 extending in the front-rear direction along the upper surface of the support plate 24 of the scanner unit 20, a vertical plate 130 extending upward from the base plate 129 along the front-rear direction, a cam portion 131 having a substantially triangular shape that protrudes upwardly from the base plate 129 at a position inside the vertical plate 130 in the width direction of the scanner unit 20, and a gear portion 132 that is fixed on an upper end of the vertical plate 130 and extends frontward from the vertical plate 130.

Four cam portions 131 are provided in association with the guide shafts 127 of the pressing members 121, and are equidistant in the front-rear direction. As shown in FIG. 14, each cam portion 131 includes an inclined surface 133 that is inclined from the lower front side to the upper rear side, and a flat surface 134 extending from a rear end of the inclined surface 133 parallel with the base plate 129.

The gear portion 132 is formed in a substantially rectangular shape in a plan view. A rack gear 135 in FIG. 16 that engages with a pressing member drive gear 401 (described below) is formed on the underside of the gear portion 132, as shown in FIG. 26.

With the first linear cams 124 disposed at the rearmost position, the base plates 129 face the guide shafts 127 of the pressing members 121. As shown in FIG. 17, by an urging force of the coil springs 123, lower ends of the pressing members 121 protrude downward below the support plate 24 via openings (not shown) formed in the holding members 122 and the support plate 24 of the scanner unit 20, and contact upper ends of the top walls 108 of the developing frames 36 of the developing cartridges 27. Thus, the pressing members 121 press the developing cartridges 27 downward, so that the developing rollers 39 of the developing cartridges 27 can be pressed against the corresponding photosensitive drum 29. At this time, force is applied by each pressing member 121 to the developing cartridges 27 in the downward direction. The downward pressing force applied by the pressing members 121 includes a component that presses the protrusions 119 of the developing cartridges 27 against the support portions 88, 96. Thus, the developing cartridges 27 can be pressed firmly against the relevant drum sub units 28 and placed in position in the drum sub units 28.

When the first linear cams 124 are moved frontward from the rearmost position, the guide shaft 127 of each pressing member 121 relatively moves along the inclined surface 133 toward the flat surface 134, so that each guide shaft 127 is raised and the support arm 125 is pivotally moved upward, as shown in FIG. 18. Thus, each pressing member 121 moves from the pressing position to the separation position. With such a structure, pressing of the developing cartridges 27 by the pressing members 121 discontinues.

A drive force transmission unit 151 will be described in detail below.

The color laser printer 1 is provided in the body casing 2 with a pair of side plates 399 (only the left side plate 399 shown in FIG. 29) opposing each other in the width direction of the laser printer 1 across the process unit 21 (FIG. 1). The drive force transmission unit 151, as shown in FIG. 19, is disposed on an outer surface of the left side plate 399 to transmit drive force to each developing cartridge 27.

Figure 19:
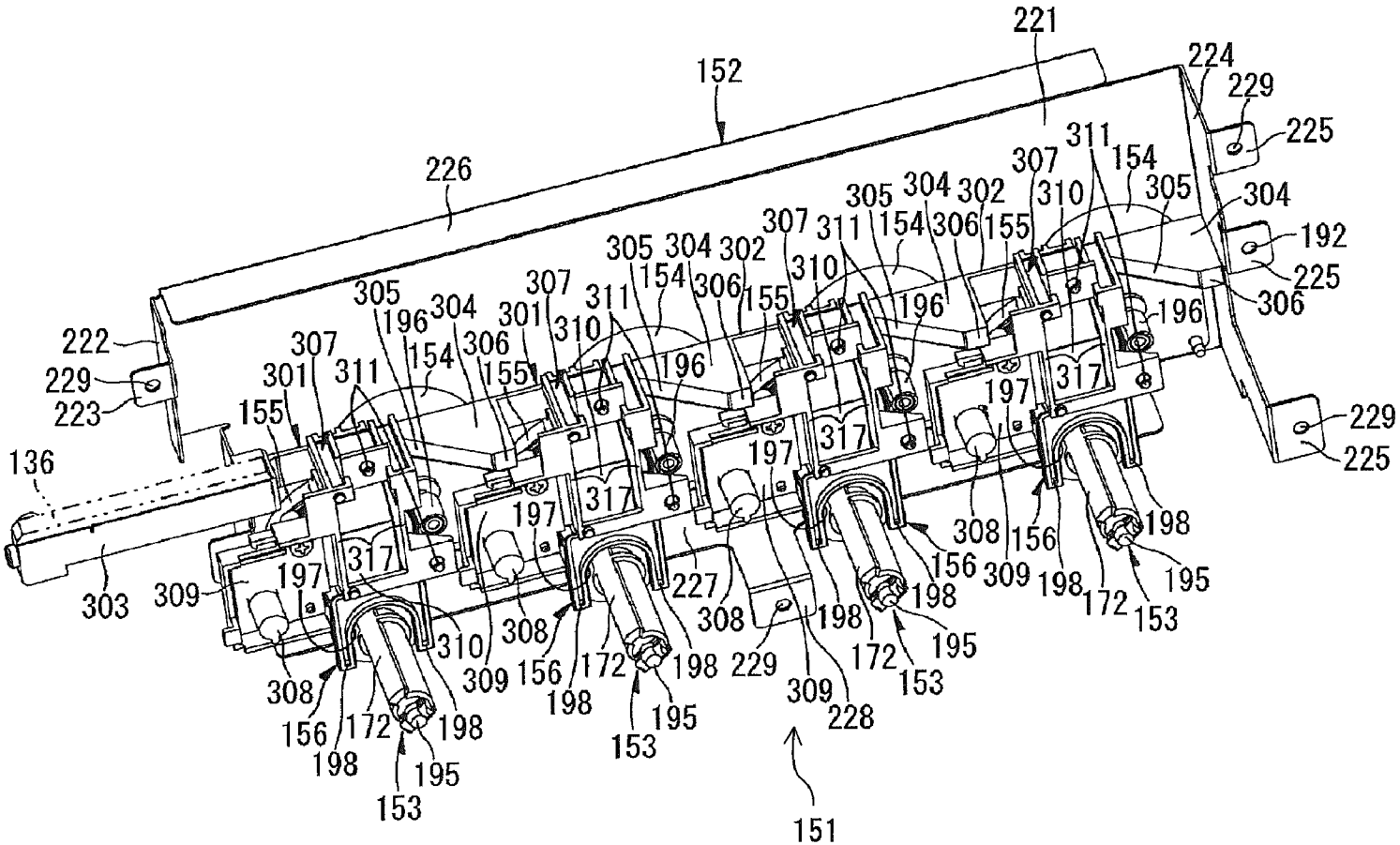
FIG. 19 is a perspective view of a drive force transmission unit provided in the color laser printer shown in FIG. 1 viewed from an upper right side.

As shown in FIG. 19, the drive force transmission unit 151 includes a holder 152 configured to be attached to the outer surface of the left side plate 399, and four drive gears 155, four coupling male members 153, four springs 191, four motors 154, and four regulating members 156 that are held by the holder 152.

The holder 152 is made of a metal plate, and integrally provided with a main plate 221, a front plate 222, a front fixing portion 223, a rear plate 224, a rear fixing portion 225, an upper plate 226, a lower plate 227, and a lower fixing portion 228. The main plate 221 is formed in a substantially rectangular shape, which extends in the front-rear direction, in a side view. The front plate 222 extends rightward toward the side plate 399 from a front edge of the main plate 221. The front fixing portion 223 extends frontward from the right end of the front plate 222. The rear plate 224 is formed in a substantially L-shape in a front view and extends rightward toward the side plate 39 from the rear edge of the main plate 221. The rear fixing portion 225 is disposed on the right end of the rear plate 224 at three positions spaced away from each other in the vertical direction. Each rear fixing portion 225 extends rearward. The upper plate 226 extends rightward toward the side plate 399 from the upper end of the main plate 221. The lower plate 227 extends rightward toward the side plate 399 from the lower end of the main plate 221. The lower fixing portion 228 is formed into a substantially L-shape in a cross section. The lower fixing portion 228 extends rightward from a substantially central portion of the lower plate 227 in the front-rear direction and bends downward.

The holder 152 is attached to the side plate 399 by first making the fixing portions 223, 225, 228 contact the outer surface of the side plate 399, inserting screws into screw holes 229 of the fixing portions 223, 225, 228, and then screwing the holder 152 on the side plate 399.

Figure 25A:
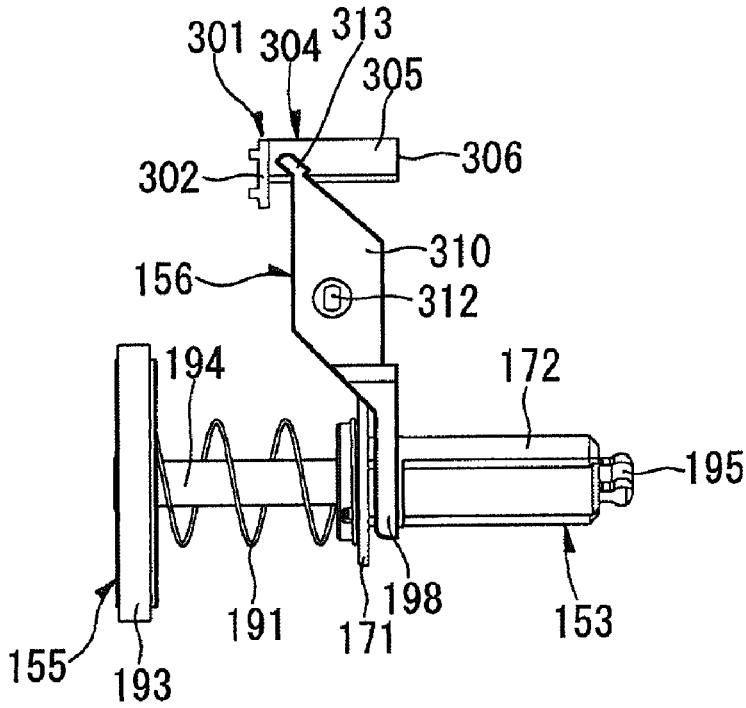
FIGS. 25A and 25B are front views of the coupling male member shown in FIG. 19.
Figure 25B:
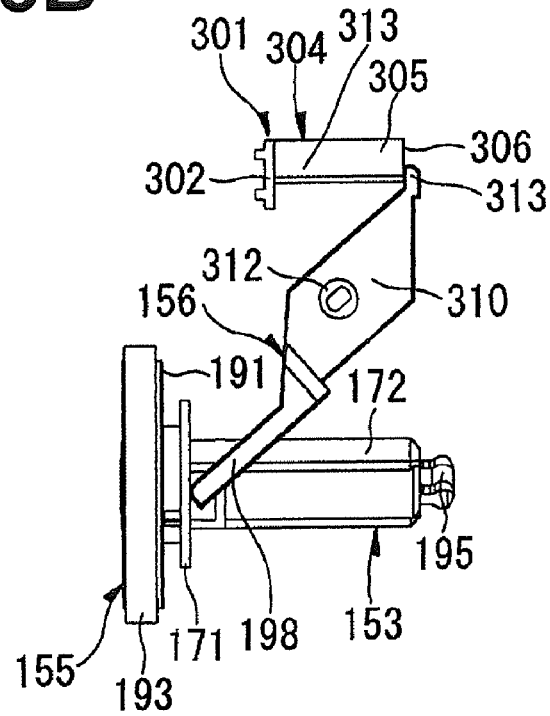

Each drive gear 155 is rotatably disposed on a surface of the main plate 221 of the holder 152 that faces the left side plate 399, at a position opposite the coupling female member 113 of each developing cartridge 27 when the drum unit 26 mounting the developing cartridges 27 thereon is installed in the body casing 2. As shown in FIGS. 25A and 25B, each drive gear 155 includes a substantially disc shaped gear body 193 and a substantially cylindrical shaped connection boss 194. The gear body 193 has teeth formed on its rim. The connection boss 194 is connected to the center of the gear body 193 so as to extend in the width direction of the printer 1.

The coupling male members 153 are arranged in the front-rear direction as shown in FIG. 19. As shown in FIGS. 25A and 25B, each coupling male member 153 integrally includes a main body 172, a flange 171, and a connection portion 195. The connection boss 194 of the drive gear 155 is slidably inserted into the main body 172 along the width direction of the printer 1 (along an axial direction of the drive gear 155), so as not to rotate relative to the main body 172. The flange 171 is disposed on a side of the main body 172 adjacent to the drive gear 155, so as to extend radially. The connection portion 195 is disposed at an end of the main body 172 opposite to the flange 171. The connection portion 195 is connected to the coupling female member 113, so as to not rotate relative to the coupling female member 113. Each coupling male member 153 is disposed so as to advance to a coupling position, as shown in FIG. 25A where the coupling male member 153 is coupled to the coupling female member 113 of the developing cartridge 27 and retract to an uncoupling position, as shown in FIG. 25B, where the coupling male member 153 is uncoupled or released from the coupling female member 113 of the developing cartridge 27.

Each spring 191 may be a compression spring, and is wound around the connection boss 194 of each drive gear 155. An end of the spring 191 is connected to the gear body 193 of the drive gear 155 and the other end is connected to the main body 172 of the coupling male member 153. The spring 191 urges the coupling male member 153 toward the coupling position.

Figure 22:
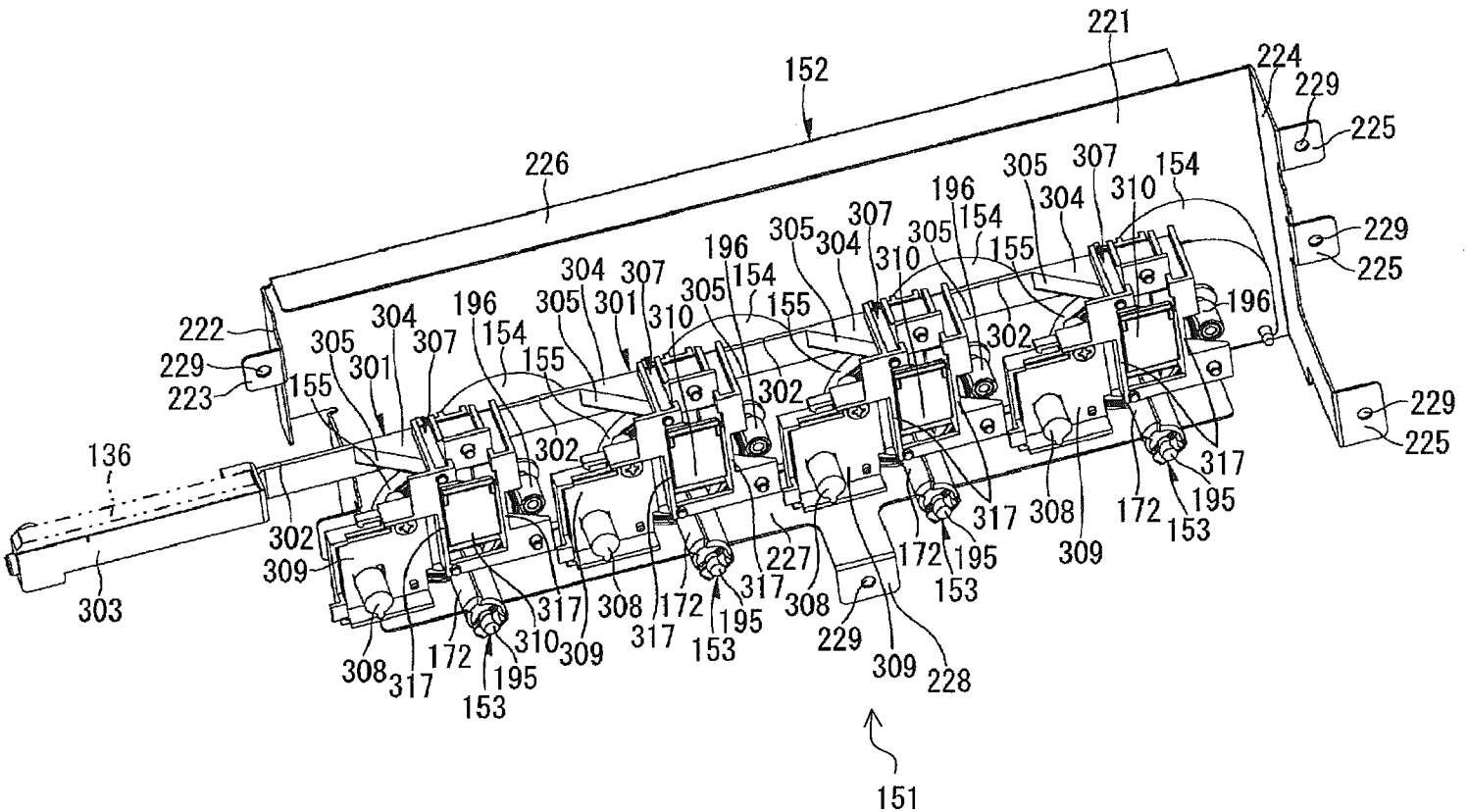
FIG. 22 is a perspective view of the drive force transmission unit shown in FIG. 19 viewed from an upper right side, wherein coupling male members of the drive force transmission unit are retracted.
Figure 23:
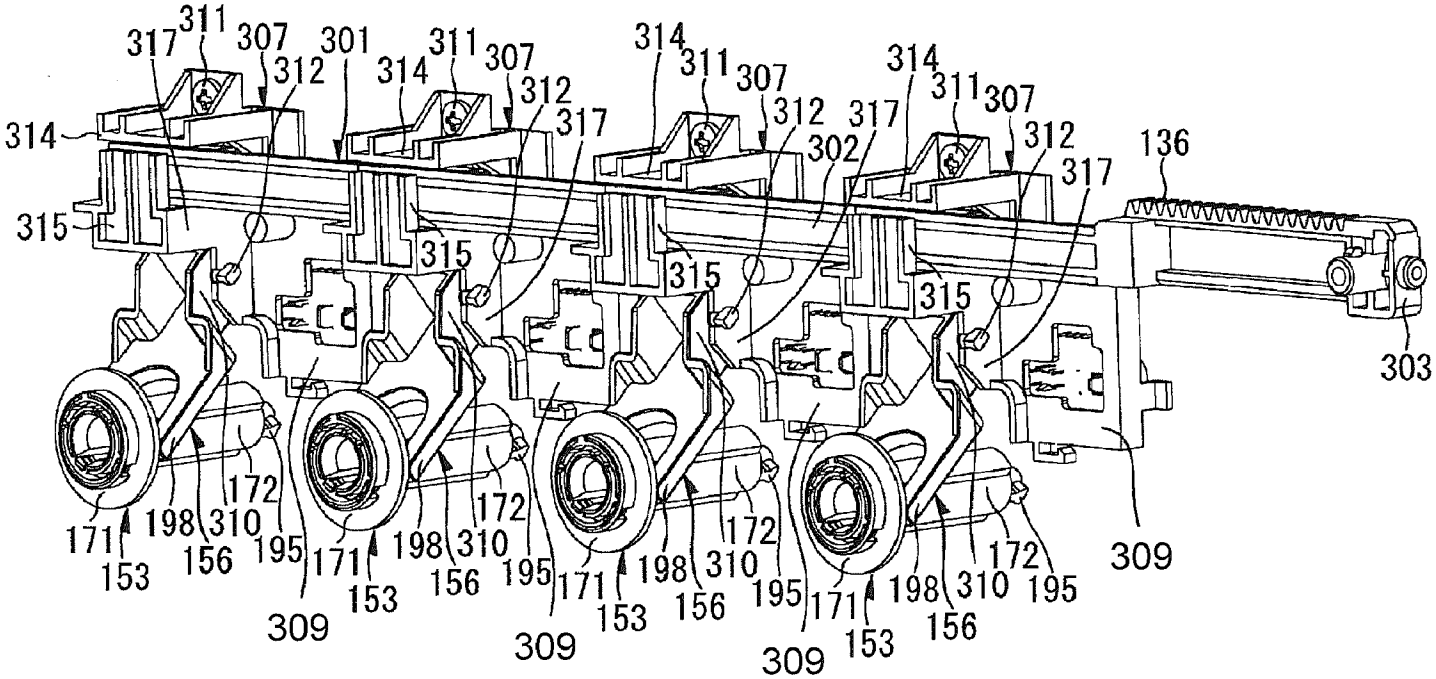
FIG. 23 is a perspective view of the drive force transmission unit shown in FIG. 22 viewed from a front left side, wherein the holder, the motors, and the developing drive gears are not shown in FIG. 23.
Figure 24:
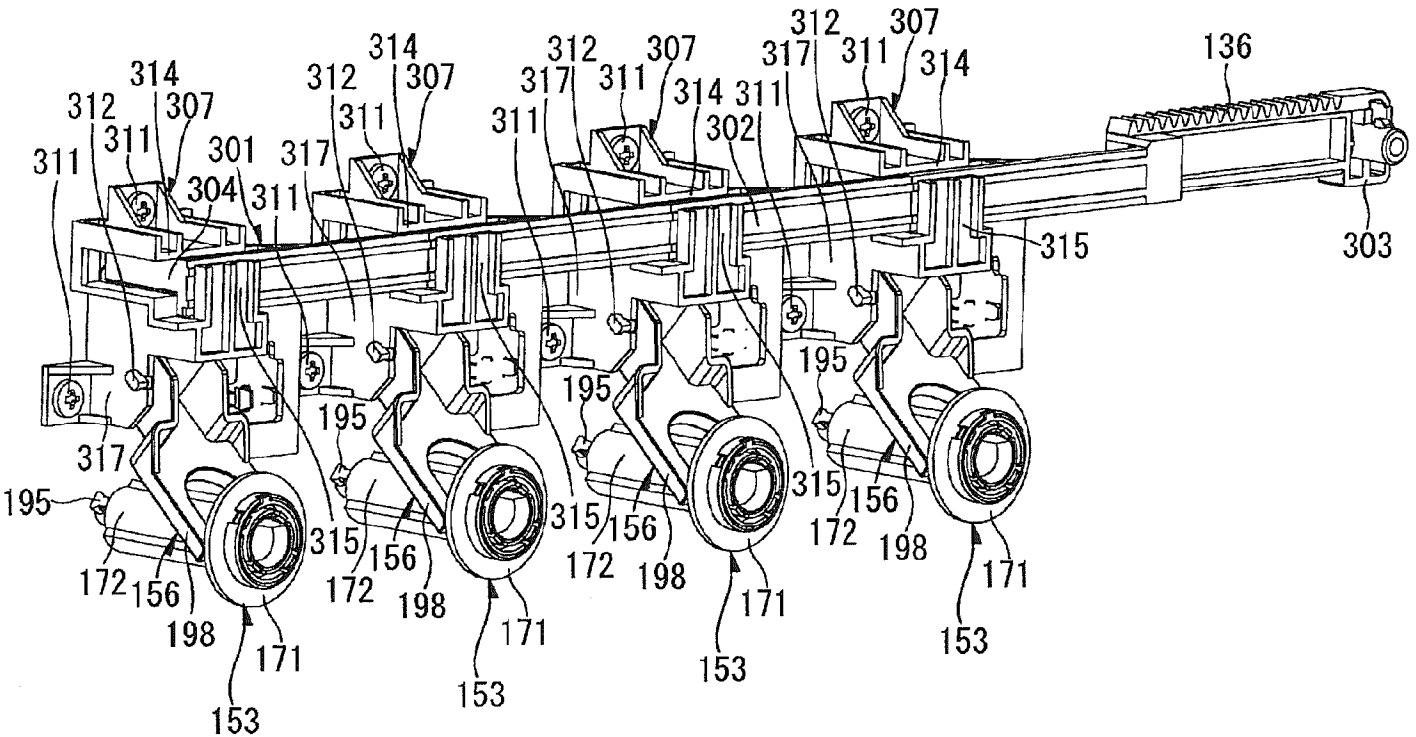
FIG. 24 is a perspective view of the drive force transmission unit shown in FIG. 22 viewed from a rear left side, wherein the holder, the motors, and the developing drive gears are not shown in FIG. 24.

As shown in FIGS. 19 and 22, each motor 154 is disposed on the surface of the main plate 221 of the holder 152 facing the side plate 399, behind the drive gear 155. Each motor 154 is disposed such that its drive shaft protrudes inward in the width direction of the printer 1. An input gear 196 configured to engage with the teeth of the corresponding drive gear 155 is fixed at the end of the drive shaft.

Each regulating member 156 is provided for each coupling male member 153, and is disposed so as to face the corresponding drive gear 155 from the inner side or right side in the width direction of the printer 1. As shown in FIGS. 25A and 25B, each regulating member 156 integrally includes a main body 310, a pivot shaft 312, a cam surface contacting portion 313, and a pair of engaging portions 198. The main body 310 is configured in a substantially parallelogram shape in a front view. The pivot shaft 312 protrudes from a central portion of the front and rear surfaces of the main body 310 in the front-rear direction. The cam surface contacting portion 313 is formed at an upper end of the main body 310 to contact an inclined surface 305 and a flat surface 306 of a second linear cam 301. The engaging portion 198 extends from the lower end of the main body 310. A cutout portion 197 having a substantially semicircular shape is formed between the engaging portions 198, to allow the main body 172 of the coupling male member 153 to pass through the cutout portion 197, as shown in FIG. 19.

In association with the four regulating members 156, four support members 307 are provided in a row along the front-rear direction between the adjacent support members 307. The regulating members 156 are pivotally and individually supported by relevant support members 307. Each support member 307 is attached to the outer surface of the left side plate 399 facing the holder 152, using screws 311. Each support member 307 includes a pair of side plates 317 opposing each other in the front-rear direction. The regulating member 156 is pivotally supported between the side plates 317 with the pivot shafts 312 rotatably received by the side plates 317.

Figure 20:
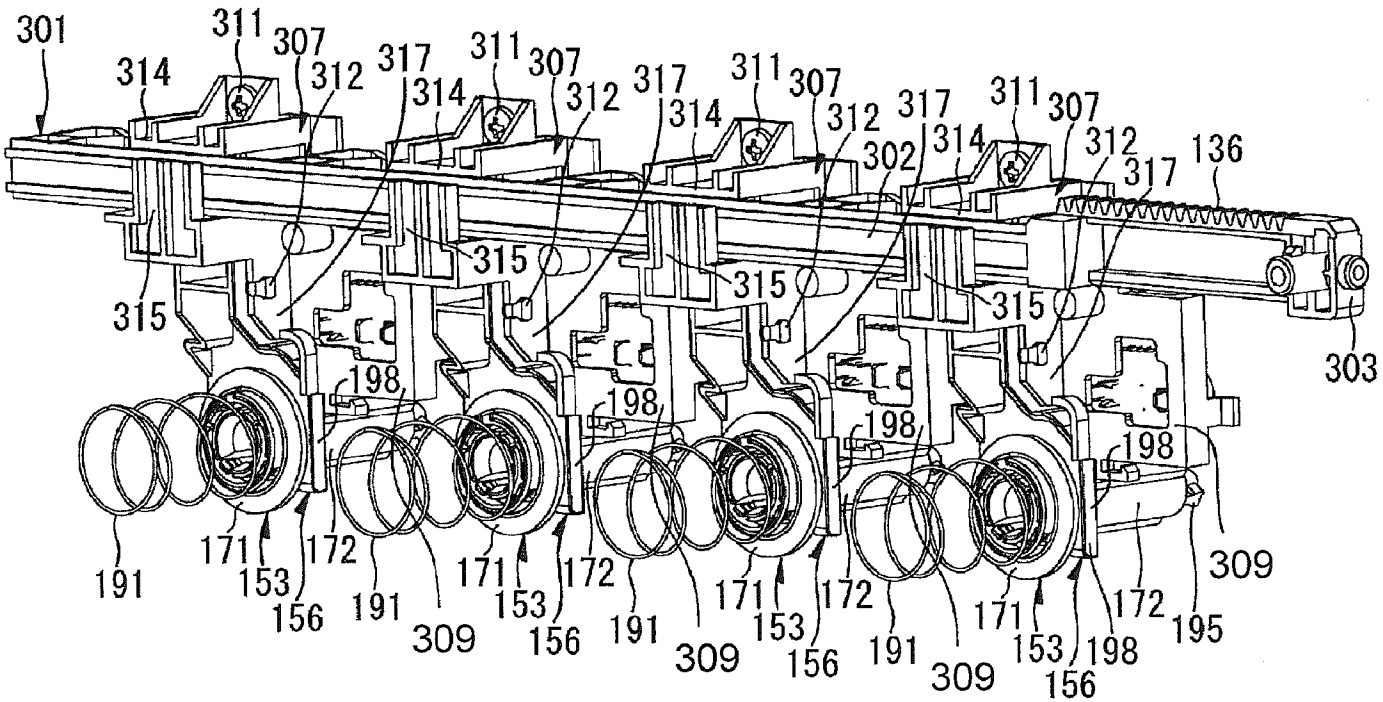
FIG. 20 is a perspective view of the drive force transmission unit shown in FIG. 19 viewed from a front left side, wherein a holder, motors, and developing drive gears are not shown in FIG. 20.

Each support member 307 includes an upper guide portion 314 and a side guide portion 315 as shown in, for example, FIG. 20. The upper guide portion 314 is configured to prevent the second linear cam 301 from moving upward and to move the second linear cam 301 in the front-rear direction. The side guide portion 315 is configured to prevent the second linear cam 301 from moving toward the holder 152 by a reaction force of the spring 191 and to move the second linear cam 301 in the front-rear direction in cooperation with the upper guide portion 314.

Each support member 307 is integrally provided with a sensor mounting portion 309 as shown in FIG. 19 that extends forward from the front-side side plate 317. In the sensor mounting portion 309, the photoreceptor 308 of the optical sensor 173 is disposed for detecting the amount of toner stored in the toner chamber 43.

Figure 21:
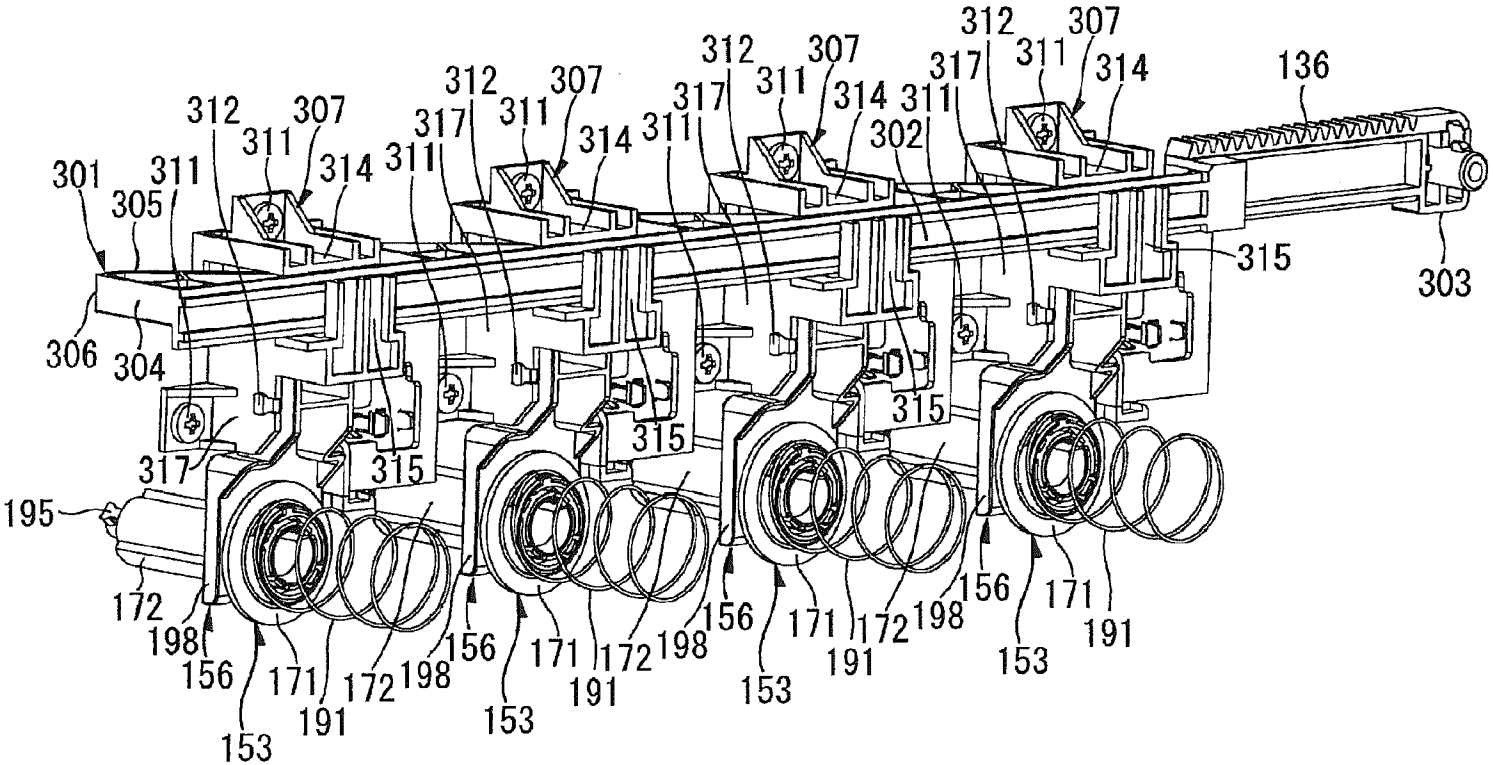
FIG. 21 is a perspective view of the drive force transmission unit shown in FIG. 19 viewed from a rear left side, wherein the holder, the motors, and the developing drive gears are not shown in FIG. 21.

The drive force transmission unit 151 is provided with the second linear cam 301 extending in the front-rear direction. The second linear cam 301 is supported by the support members 307 so as to move linearly in the front-rear direction, which is a direction substantially parallel with the pivot shafts 312 of the regulating members 156. As shown in FIG. 21, the second linear cam 301 integrally includes a lever body 302 formed in a rectangular shape elongated in the front-rear direction, a gear portion 303 connected to a front end of the lever body 302, and cam portions 304, each formed in a substantially triangular shape and protruding from an inner surface of the lever body 302.

A rack gear 136 is formed on an upper surface of the gear portion 303. The rack gear 136 is configured to engage with a joint movable gear 404, as will be described below with reference to FIGS. 26 and 27.

Four cam portions 304 are provided in association with the four regulating members 156 and arranged on a surface of the lever body 302 facing the side plate 399 at regular intervals in the front-rear direction. As shown in FIG. 19, each cam portion 304 includes an inclined surface 305 extending from the left front side to the right rear side, and a flat surface 306 extending from a rear end of the inclined surface 305 in parallel with the surface of the lever body 302.

When the second linear cam 301 is placed in the rearmost position, each regulating member 156 is disposed in the front of each cam portion 304 while facing the inner surface of the lever body 302, as shown in FIGS. 19 and 25A. Each regulating member 156 is in a coupling position where the pair of engaging portions 198 faces the flange 171 of the coupling male member 153 but does not contact the flange 171 due to the elastic force of the spring 191. In this state, each coupling male member 153 is in the coupling position where it is coupled with the corresponding coupling female member 113 of the developing cartridge 27 if the drum unit 26 mounting therein the developing cartridges 27 is installed in the body casing 2.

When the second linear cam 301 is moved forward from the rearmost position, the cam contacting portion 313 moves correspondingly on the inclined surface 305 of the cam portion 304 toward the flat surface 306 as shown in FIG. 22. Consequently, each regulating member 156 pivots on the corresponding pivot shaft 312, and ends of the engaging portions 198 are brought into contact with the flange 171 of each coupling male member 153 as shown in FIG. 25B. The engaging portions 198 press the flange 171 toward the uncoupling position against the elastic force of the spring 191. Thus, the coupling male members 153 move from the coupling position to the uncoupling position where the ends of the engaging portions 198 are brought into contact with a central position of the flange 171 in its vertical direction. In this state, connection between the coupling female members 113 of the developing cartridges 27 and the corresponding coupling male members 153 is discontinued.

An interlocking mechanism 400 will be described in detail below with reference to FIGS. 26 and 27.

The color laser printer 1 includes the interlocking mechanism 400 for interlocking the first linear cams 124 and the second linear cam 301 so as to move the cams 124, 301 in association with the opening and closing operations of the front cover 9.

Figure 27:
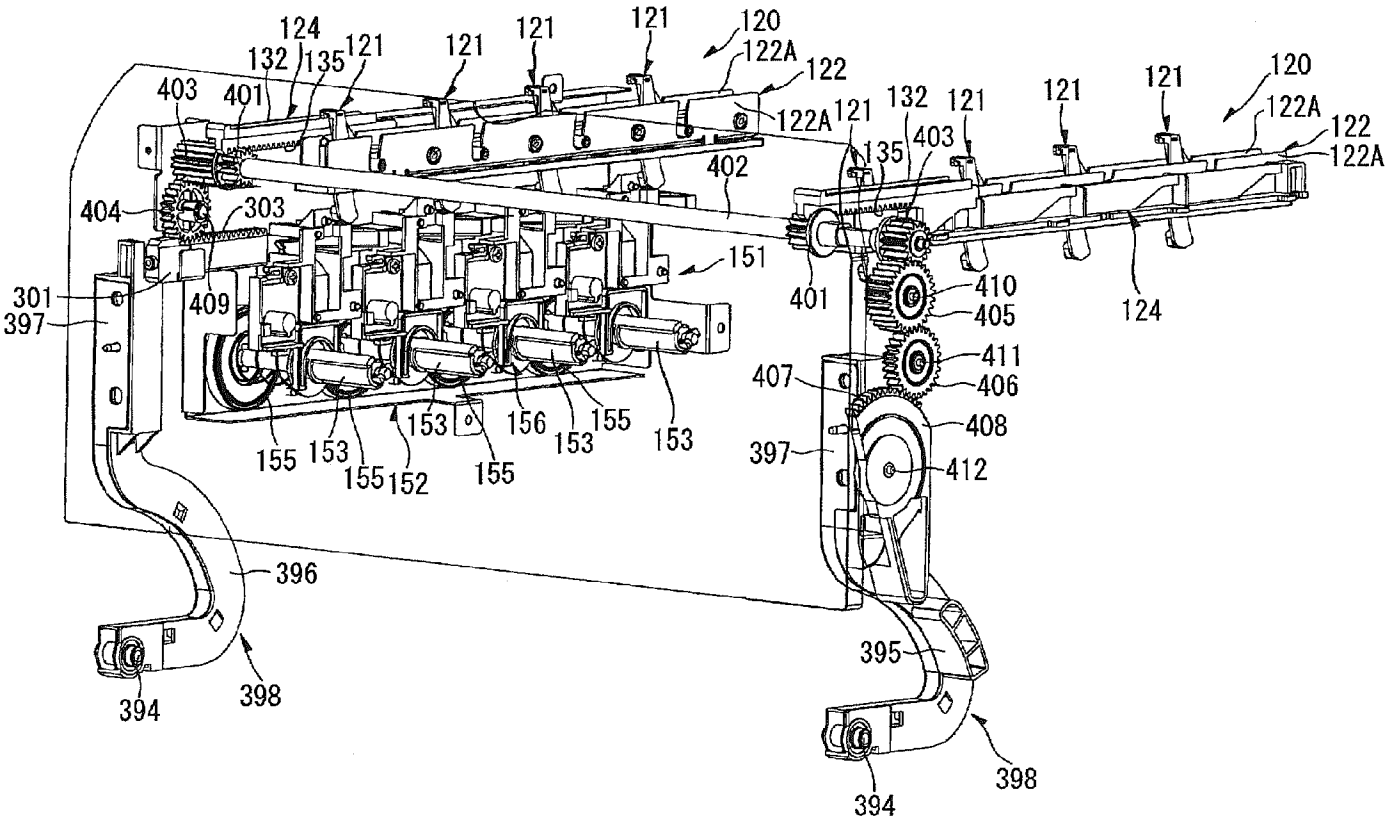
FIG. 27 is a perspective view of the pressing mechanisms, the drive force transmission unit, and the interlocking mechanism provided in the laser printer shown in FIG. 1, viewed from a front right side when the front cover is closed.

The front cover 9 is openably and closably supported by a pair of cover support members 398, so that it is movable between an open position, as shown in FIG. 26, where the front cover 9 is inclined frontward of the body casing 2 to uncover the opening 8, and a closed position, as shown in FIG. 27, where the front cover 9 is in an upright position along the front face of the body casing 2 to cover the opening 8.

Each cover support member 398 integrally includes a cover fixing portion 397 fixed at an end of the front cover 9 in the width direction of the printer 1, and a bending portion 396 that is connected to the lower end of the cover fixing portion 397 when the front cover 9 is closed. The bending portion 396 extends rearward and bends so as to form a substantially "U" shape in a side view when the front cover 9 is closed. The right-side cover support member 398 is integrally formed with an operation part 395 for operating an operation gear member 408 (described below) on an outer surface of the bending portion 396. The operation part 395 is formed to extend toward the front cover 9 from a portion near a curved or knee portion of the bending portion 396. A support shaft 394 extending in the width direction of the printer 1 from an end of the bending portion 396 is rotatably received in each side plate 399 of the body casing 2.

The interlocking mechanism 400 includes pressing member drive gears 401, a holding shaft 402, transmission gears 403, a joint movable gear 404, an intermediate gear 405, an input gear 406, and an operation gear member 408. The pressing member drive gears 401 engage with the rack gears 135 of the gear potions 132 of the first linear cams 124. The holding shaft 402 is rotatably supported by the side plates 399 within the body casing 2. The pressing member drive gears 401 are fitted over the holding shaft 402, so as to avoid rotating relative to the holding shaft 402. The transmission gears 403 are mounted to the ends of the holding shaft 402 so as to avoid rotating relative to the holding shaft 402. The joint movable gear 404 engages with the transmission gear 403 mounted on the left end of the holding shaft 402 and the rack gear 136 of the gear portion 303 of the second linear cam 301. The intermediate gear 405 engages with the transmission gear 403 mounted on the right end of the holding shaft 402. The input gear 406 engages with the intermediate gear 405. The operation gear member 408 has a gear 407, which engages with the input gear 406, formed on a perimeter of the operation gear member 408.

The joint movable gear 404 is provided rotatably on a shaft 409 that extends in the width direction of the printer 1 and is received in the left side plate 399.

The intermediate gear 405 and the input gear 406 are provided rotatably on a shaft 410 and a shaft 411, respectively, which extend in the width direction of the printer 1 and are rotatably received in the right side plate 399.

The operation gear member 408 is provided rotatably on a shaft 412, which extends in the width direction of the printer 1 and is rotatably received in the right side plate 399. As shown in FIG. 26, with the front cover 9 open, an end of the operation gear member 408 opposite to the gear 407 contacts the operation part 395 of the cover support member 398 from above, and one end of the gear 407 engages with the input gear 406. As shown in FIG. 27, with the front cover 9 closed, the end of the operation gear member 408 opposite to the gear 407 contacts the operation part 395 from the front, and the other end of the gear 407 engages with the input gear 406.

With this configuration, when the front cover 9 is opened, the operation part 395 forwardly presses the end of the operation gear member 408 opposite to the gear 407. The operation gear member 408 rotates about the shaft 412 (in the clockwise direction in FIGS. 26 and 27). With the rotation of the operation gear member 408, the input gear 406 is rotated (in the counterclockwise direction in FIGS. 26 and 27). The rotation of the input gear 406 is transmitted to the right-side transmission gear 403 via the intermediate gear 405. Accordingly, the right-side transmission gear 403, the holding shaft 402, the pressing member drive gears 401, and the left-side transmission gear 403 are rotated (in the counterclockwise direction in FIGS. 26 and 27). As a result, the first linear cams 124 are moved frontward, so that pressing of the developing cartridges 27 by the corresponding pressing members 121 is discontinued. With the rotation of the left-side transmission gear 403, the second linear cam 301 moves frontward, and the coupling male members 153 move from the coupling position to the uncoupling position. Thus, the connection between each coupling female member 113 of the developing cartridge 27 and the corresponding coupling male member 153 discontinues.

When the front cover 9 is closed, the operation part 395 of the cover support member 398 backwardly presses the end of the operation gear member 408 opposite to the gear 407, so that the operation gear member 408 is rotated on the shaft 412 (in the counterclockwise direction in FIGS. 26 and 27). With the rotation of the operation gear member 408, the input gear 406 is rotated (in the clockwise direction in FIGS. 26 and 27). The rotation is transmitted to the right-side transmission gear 403 via the intermediate gear 405. Accordingly, the right-side transmission gear 403, the holding shaft 402, the pressing member drive gears 401, and the left-side transmission gear 403 are rotated (in the counterclockwise direction in FIG. 26). As a result, the first linear cams 124 are moved rearward, the developing cartridges 27 are pressed by the corresponding pressing members 121. With the rotation of the left-side transmission gear 403, the second linear cam 301 moves rearward, and the coupling male members 153 move to the coupling position from the uncoupling position, and the coupling female member 113 of each developing cartridge 27 and the corresponding coupling male member 153 are coupled with each other.

A contact/separation mechanism 500 will be described in detail below.

Figure 28:
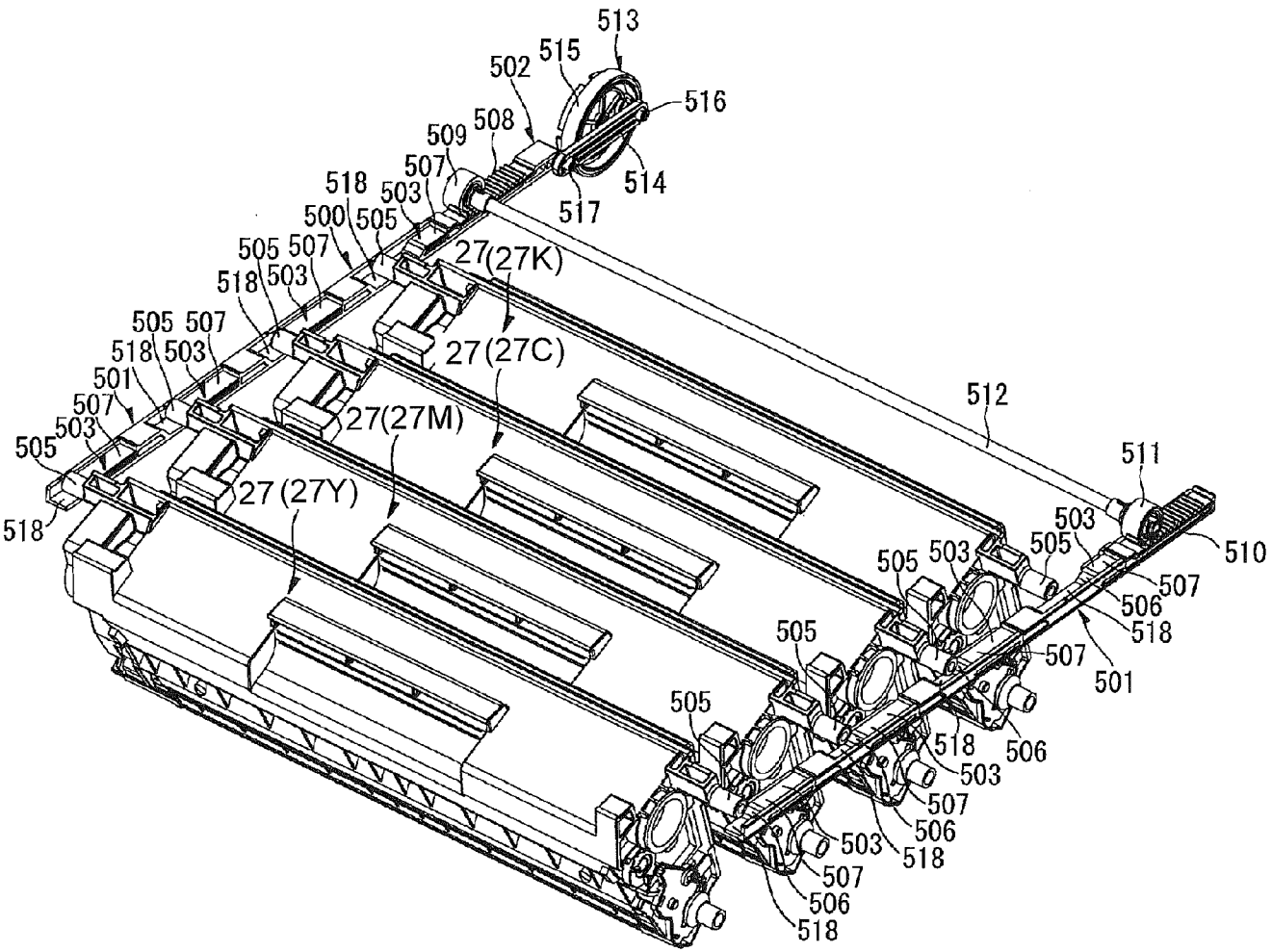
FIG. 28 is a perspective view of a contact-separation mechanism provided in the color laser printer shown in FIG. 1 viewed from an upper front right side.

As shown in FIG. 28, the color laser printer 1 includes a contact/separation mechanism 500 configured to linearly move the developing cartridges 27 between a contact position where the developing rollers 39 contact the corresponding photosensitive drums 29 and a separation position where the developing rollers 39 separate from the corresponding photosensitive drums 29.

As shown in FIG. 28, the contact/separation mechanism 500 includes a pair of contact/separation members 501 and a synchronous moving mechanism 502. The contact/separation members 501 are disposed so as to face each other across the four developing cartridges 27 in the longitudinal direction of the developing cartridges 27. The contact/separation members 501 are configured to move straightly in the front-rear direction. The synchronous moving mechanism 502 is configured to linearly move the contact/separation members 501 in synchronization with each other.

Figure 29:
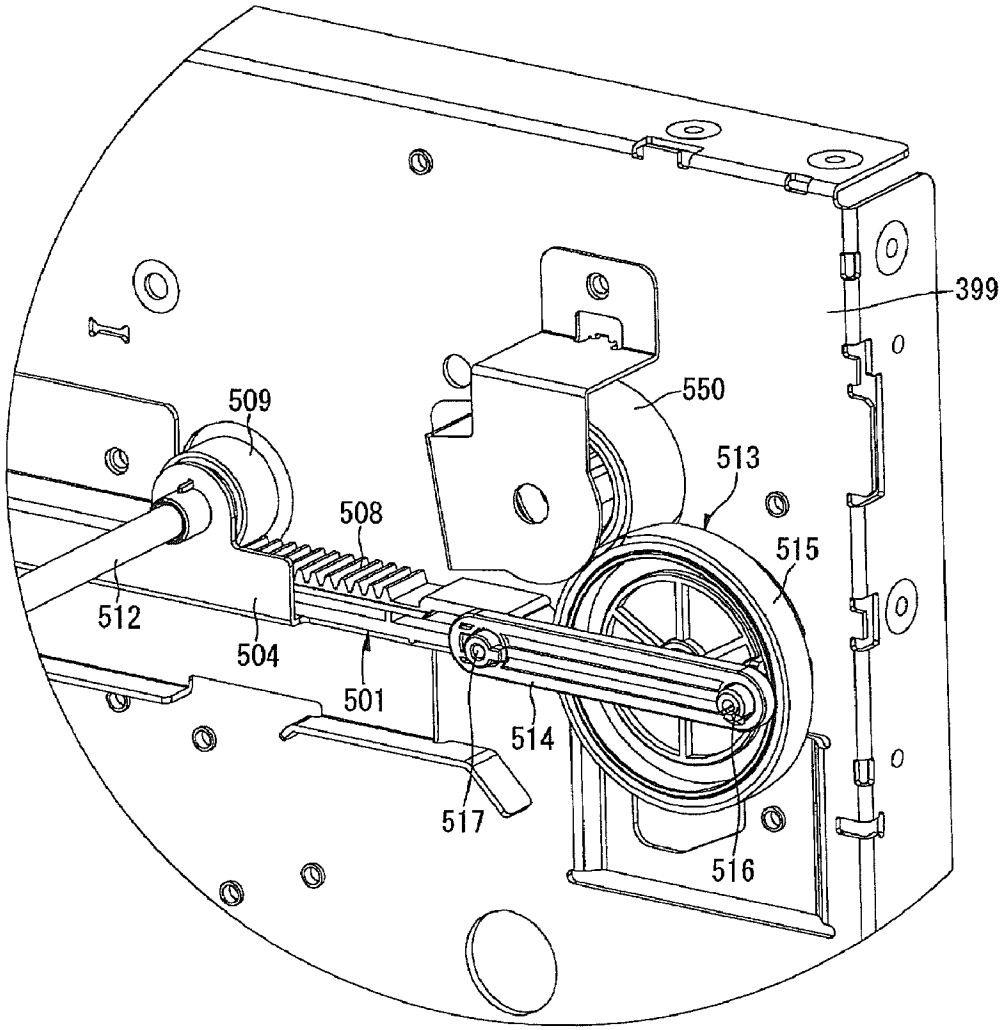
FIG. 29 is a perspective view of a rear end of a left contact-separation member shown in FIG. 28.

Each contact/separation member 501 is formed in a substantially plate shape elongated in the front-rear direction and includes cam portions 503 of a substantially trapezoidal shape in a side view formed on an upper surface of the contact/separation member 501. Each contact/separation member 501 is provided on an inner surface of each side plate 399, which is disposed within the body casing 2 as shown in FIG. 29. Each contact/separation member 501 is slidably held by a substantially L-shaped contact/separation member holder 504 in a cross section that extends in the front-rear direction. Each contact/separation member 501 contacts protrusions 505 of the developing cartridges 27 from underneath. The protrusion 505 extends outwardly along the longitudinal direction of the developing cartridge 27 from an upper end of each sidewall 107 of the developing frame 36 of the developing cartridge 27.

Four cam portions 503 are provided in each contact/separation member 501, in association with the protrusions 505. Each cam portion 503 includes a slide surface 506 provided at an angle from the lower front side to the upper rear side, and a flat separation surface 507 that extends from a rear end of the slide surface 506 in parallel with an upper surface of the contact/separation member 501.

Figure 30A:
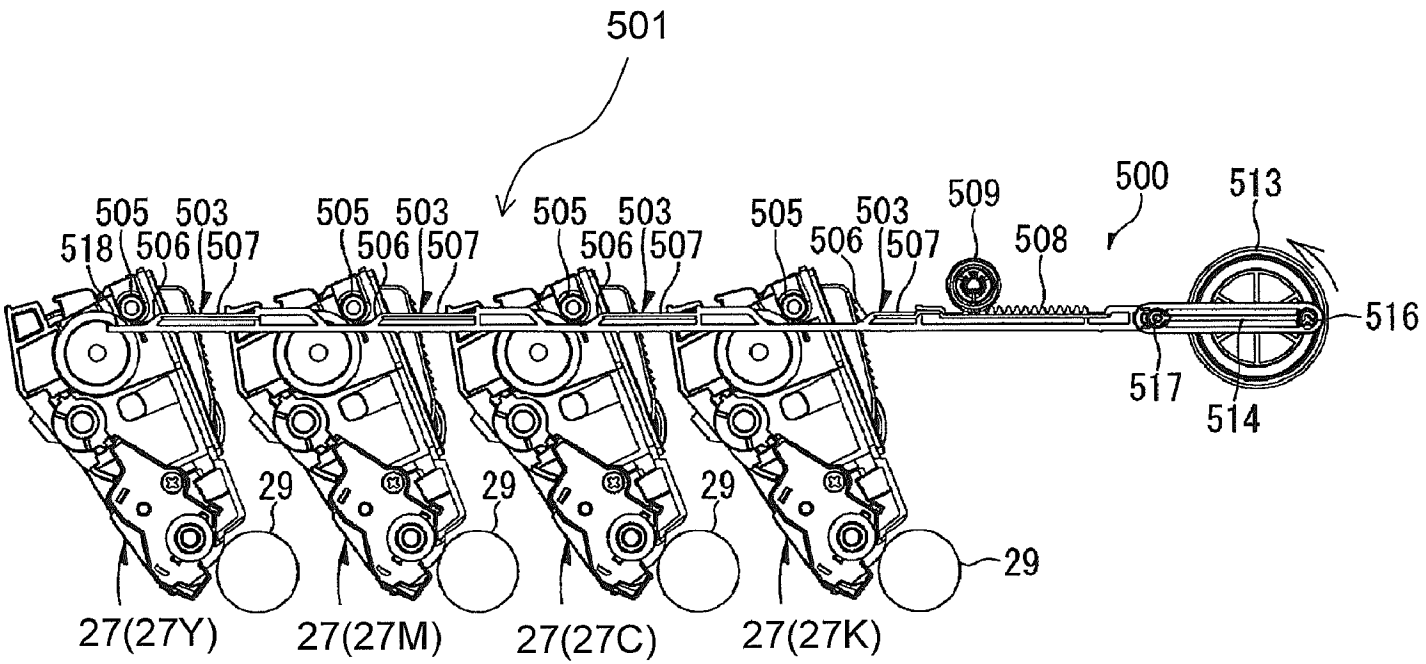
FIGS. 30A to 30C are right side views of the developing cartridges pressed against or separated from corresponding photoconductive drums by the contact-separation members.
Figure 30B:
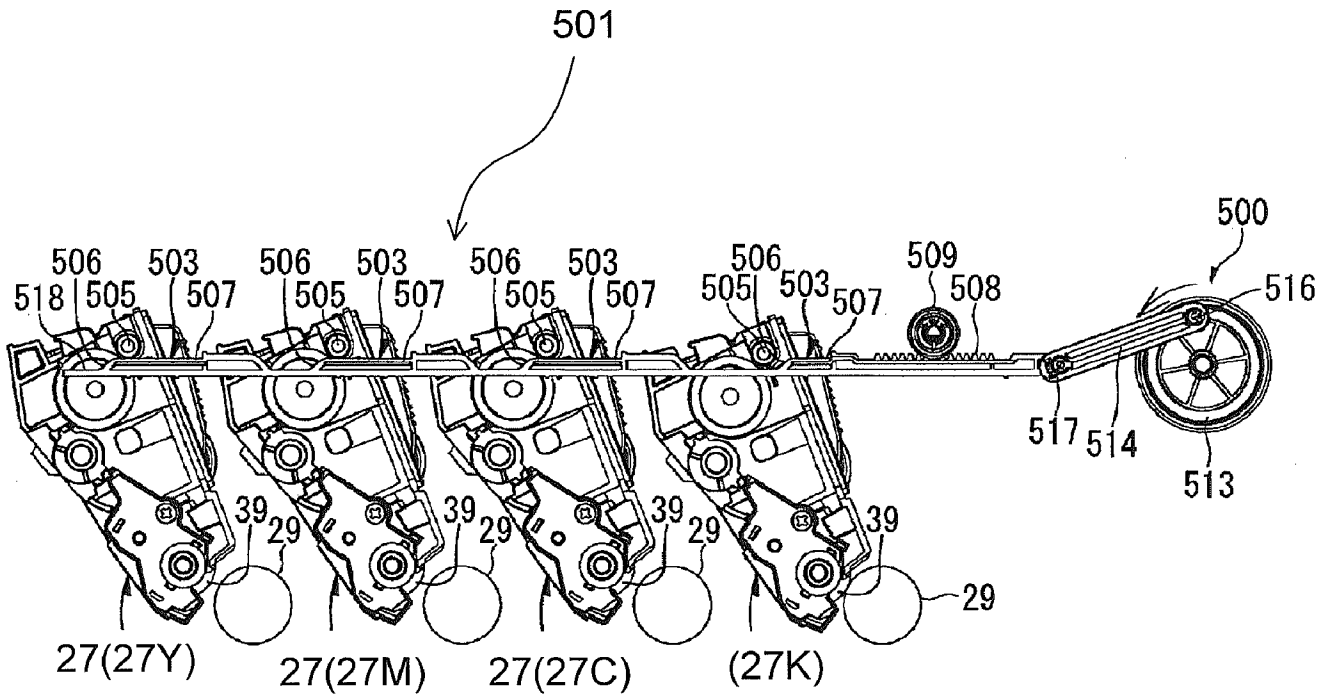
Figure 30C:
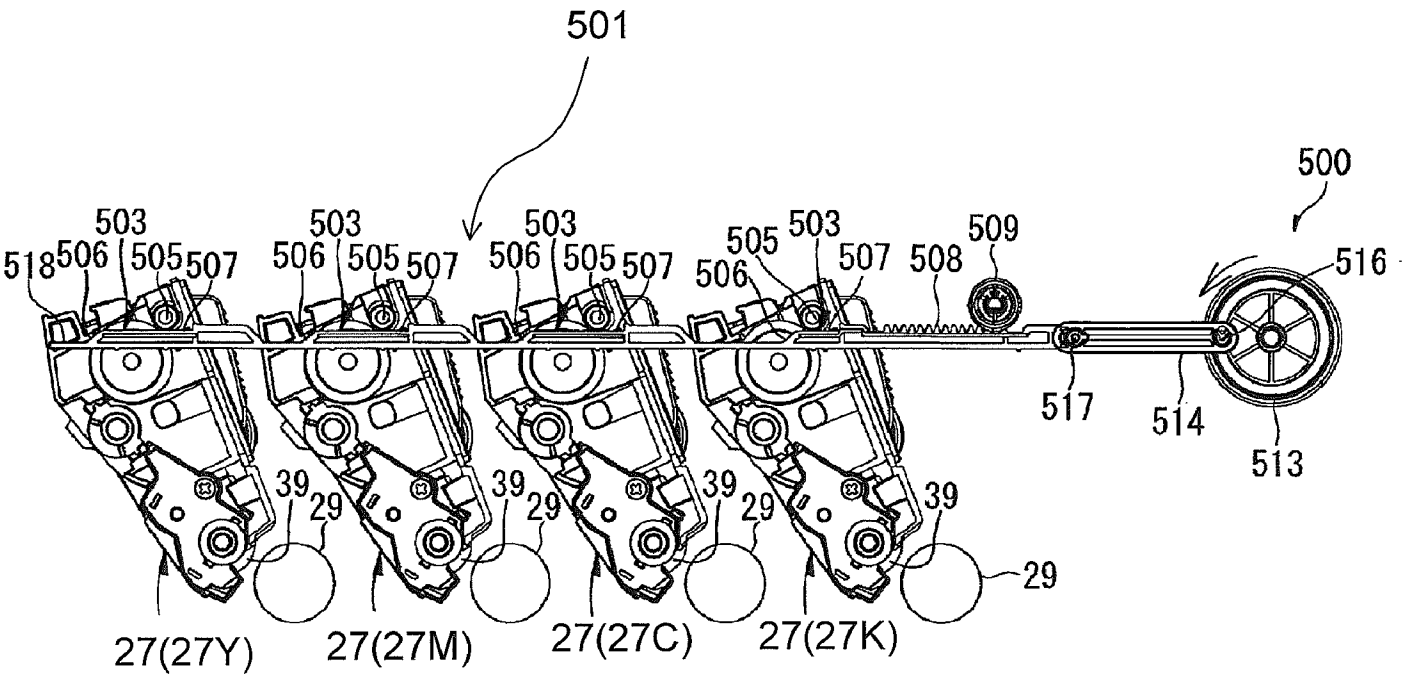

In association with the positions of the contact/separation members 501, the four cam portions 503 take states as shown in FIGS. 30A-30C, i.e., a state where all protrusions 505 are positioned in the front of the corresponding cam portions 503 as shown in FIG. 30A; a state where the protrusion 505 of the black developing cartridge 27K only is positioned in the front of the corresponding cam portion 503 and other protrusions 505 are disposed on the corresponding cam portions 503 as shown in FIG. 30B; and a state where all protrusions 505 are disposed on the corresponding cam portions 503 as shown in FIG. 30C.

More specifically, the first three cam portions 503 from the front side are formed into the substantially same shape and are disposed equidistantly. The distance between the last (rearmost) cam portion 503 and the third cam portion 503 is greater than a distance between each of the other three cam portions 503. The rearmost cam portion 503 has the separation surface 507 shorter that that of other three cam portions 503 in the front-rear direction.

The synchronous moving mechanism 502 is configured to transmit drive force from the left contact/separation member 501 to the right contact/separation member 501, in association with the linear movement of the left separation member 501, to linearly move the right separation member 501.

More specifically, as shown in FIGS. 28 and 29, the synchronous moving mechanism 502 includes a left rack gear 508, a left pinion gear 509, a right rack gear 510, a right pinion gear 511, a connecting shaft 512, a transmission gear 550, a crank gear 513, and a conversion member 514. The left rack gear 508 is formed on an upper rear surface of the left contact/separation member 501. The left pinion gear 509 is configured to engage with the left rack gear 508. The right rack gear 510 is formed on an upper rear surface of the right contact/separation member 501. The right pinion gear 511 is configured to engage with the right rack gear 510. The connecting shaft 512 mounts the left pinion gear 509 and the right pinion gear 511 on each end thereof such that the left pinion gear 509 and the right pinion gear 511 do not rotate relative to the shaft 512. The transmission gear 550 is fixed on the left side plate 399 and is configured to transmit drive force from a motor (not shown). The crank gear 513 is rotated in one direction (e.g., in the counterclockwise direction in FIG. 30) with the rotating force of the transmission gear 550. The conversion member 514 is configured to convert the rotation of the crank gear 513 into linear movement for the left separation member 501.

The left pinion gear 509 and the right pinion gear 511 engage with the left rack gear 508 and the right rack gear 510, respectively, at their front ends when the contact/separation members 501 are moved to the rearmost positions, as shown in FIG. 30A. When the contact/separation members 501 are moved to the foremost positions as shown in FIG. 30C, the left pinion gear 509 and the right pinion gear 511 engage with the left rack gear 508 and the right rack gear 510, respectively, at their rear ends.

The connecting shaft 512 is disposed between the contact/separation member holders 504, and rotatably supported by the holders 504 as shown in FIG. 29.

The crank gear 513 is rotatably supported by a central shaft, which extends in the width direction of the printer 1 and is received in the side plate 399. A gear 515 that engages with the transmission gear 550 is formed on the perimeter of the crank gear 513. The crank gear 513 is formed with a rear-side protruding shaft 516 that protrudes inward in the width direction of the printer 1.

The rearmost end of the left contact/separation member 501 is formed with a front-side protruding shaft 517 that protrudes inward in the width direction of the printer 1. When the contact/separation member 501 is in the rearmost position or the foremost position, as shown in FIGS. 30A and 30C, the front-side protruding shaft 517 faces the rear-side protruding shaft 516 in the front-rear direction in parallel with each other.

The conversion member 514 is disposed between the rear-side protruding shaft 516 and the front-side protruding shaft 517, such that an end of the conversion member 514 moves along a movement path of the rear-side protruding shaft 516 when the crank gear 513 is rotated.

As shown in FIG. 30A, when the contact/separation members 501 are moved to the rearmost position, each protrusion 505 of the developing cartridges 27 is placed in front of the corresponding cam portion 503, and contacts a contact surface 518 which is an upper surface of the contact/separation members 501. Each developing cartridge 27 is placed in the contact position where the developing roller 39 of each developing cartridge 27 is pressed against the corresponding photosensitive drum 29.

As the transmission gear 550 is rotated by drive force from the motor (not shown) in the state as shown in FIG. 30A, the crank gear 513 is rotated counterclockwise in FIG. 30A. Accordingly, the rear-side protruding shaft 516 moves frontward, and the left contact/separation member 501 moves frontward. With the movement of the left contact/separation member 501, the left pinion gear 509 rotates clockwise in FIG. 30B, and the rotation of the left pinion gear 509 is transmitted to the right pinion gear 511 via the connecting shaft 512. The right pinion gear 511 rotates in the same direction as the left pinion gear 509, and consequently, the right contact/separation member 501 moves frontward. As shown in FIG. 30B, when the crank gear 513 rotates approximately 90 degrees from the state shown in FIG. 30A, the protrusions 505 of the yellow, magenta and cyan developing cartridges 27Y, 27M, 27C slide on the sliding surfaces 506 of the corresponding cam portions 503 and are raised on the separation surfaces 507 of the corresponding cam portions 503. The protrusions 505 of the black developing cartridge 27K are positioned in the front of the corresponding cam portions 503. Thus, the yellow developing cartridge 27Y, the magenta developing cartridge 27M, and the cyan developing cartridge 27C are moved upward to the separation position, and their developing rollers 39 separate from the corresponding photosensitive drums 29. Only the developing roller 39 of the black developing cartridge 27K is in contact with the corresponding photosensitive drum 29.

As shown in FIG. 30C, when the crank gear 513 is rotated counterclockwise approximately 180 degrees from the state shown in FIG. 30A, by driving the motor, the contact/separation members 501 are moved to the foremost position, the protrusions 505 of all developing cartridges 27 are raised on the separation surfaces 507 of the corresponding cam portions 503. Thus, all the developing cartridges 27 are moved up to the separation position where the developing rollers 39 of the developing cartridges 27 separate from the corresponding photosensitive drums 29.

When the motor is further driven to rotate the crank gear 513 counterclockwise in FIG. 30C, the rear-side protruding shaft 516 is moved rearward and accordingly the pair of contact/separation members 501 is moved rearward. When the crank gear 513 is rotated 180 degrees from the state shown in FIG. 30C, all the developing cartridges 27 are placed in the contact position as shown in FIG. 30A.

Figure 31:
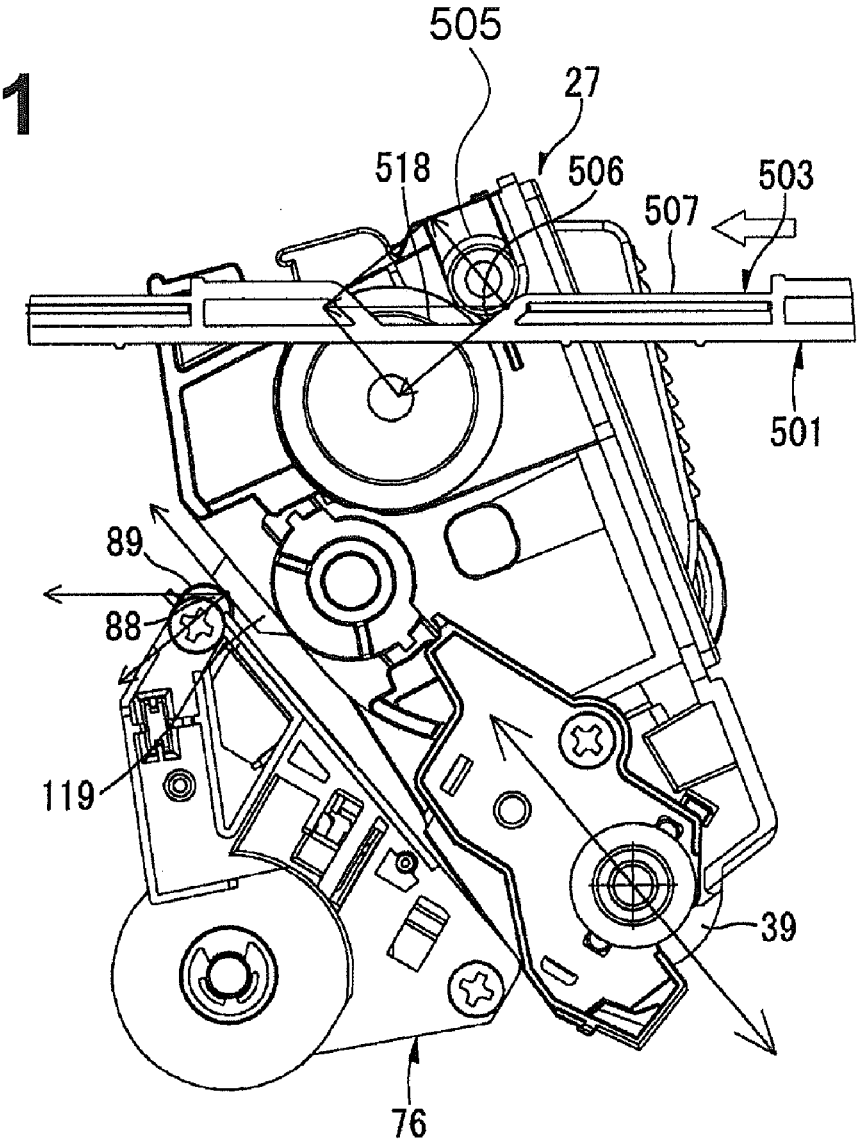
FIG. 31 is a right side view of one developing cartridge shown in FIG. 28 and its periphery.

When the developing cartridge 27 is raised by the cam portions 503, the protrusions 505 that slide on the sliding surfaces 506 of the cam portions 503 experience a frontward force from the sliding surface 506 as shown in FIG. 31. The force that the protrusion 505 experiences from the sliding surface 506 is resolved into a component acting in a direction parallel to the sliding surface 506 and a component acting in a direction perpendicular to the sliding surface 506. In the color laser printer 1, the slope of the sliding surface 506 of each cam portion 503 is parallel with a direction that the protrusion 119 of the developing cartridge 27 presses the support portion 88 (96). Thus, the component of force acting in the direction parallel to the sliding surface 506 acts as a force for pressing the protrusion 119 against the support portion 88 (96). As a result, the protrusion 119 can be firmly pressed against the support portion 88 (96), and the developing cartridges 27 can be stably moved from the contact position to the separation position.

According to some of the aspects, when the developing cartridges 27 are mounted in the relevant drum sub units 28, the collar members 111 protruding from the developing cartridges 27 fit in the guide grooves 77 formed in the side frames 75 of the drum sub units 28 and the protrusions 119 of the developing cartridges 27 are pressed against the support portions 88, 96. The developing cartridges 27 may be supported at the support portions 88, 96 and the protrusions 119 so that stress applied to the collar members 111 when the developing rollers 39 are driven may be lessened. Consequently, damage to the collar members 111 when the developing rollers 39 are driven may be prevented. The support portions 88 are provided on the center frame 76 supporting the charger 30. Therefore, another member does not have to be additionally provided for the support portions 88.

The support portions 96 are provided on the front beam 72. Therefore, while complexity in the structure of the drum unit 26 is prevented, damage to the collar member 111 when the developing roller 39 is driven may be prevented.

Further, when the developing roller 39 is driven, the developing cartridges 27 may vibrate and the support portions 88, 86 may slide on the protrusions 119. However, with the friction reduction tape 89 affixed to a surface of each support portion 88, 96, friction between the protrusions 119 and the support portions 88, 96 may be prevented with a simple structure.

The distance between the developing cartridges 27 and the center frame 76/front beam 72 is determined by the projection length of the protrusions 119. Thus, the distance between the developing cartridges 27 and the center frame 76/front beam 72 may be precisely controlled.

Further, by appropriately setting the projection length of the protrusions 119, the space is ensured between the developing cartridges 27 and the center frames 76. Thus, unfavorable contact between the developing cartridges 27 and the center frames 76 (parts of the developing cartridge 27 other than the protrusions 119 contacts parts of the center frames 76 other than the support portions 88) may be prevented. While the unfavorable contact between the developing cartridges 27 and the center frames 76 is prevented, the charger covers 85 are disposed in the space between the developing cartridges 27 and the center frames 76. Thus, the space can be effectively used and in turn, the downsizing of the printer 1 can be achieved.

In some of the aspects, the developing cartridge 27 tilts or pivots about the developing roller shaft 51 (or the collar members 111) of the developing cartridge 27, under its own weight, such that the upper end of the developing cartridge 27 is moved frontward against the adjacent center frame 76 or the front beam 72 in front of the developing cartridge 27. Thus, the protrusions 119 formed in the front wall 109 of the developing frame 36 is brought into contact with and supported by the support portions 88 of the center frame 76 or the support portions 96 of the front beam 72. Thus, the developing cartridges 27 can be placed in position in the drum sub unit 28.

When the drive force is input from the motor 154 to the female coupling member 113 of the developing cartridges 27, the moment of rotation is applied to the developing cartridge 27. With the moment of rotation, the protrusions 119 can be further pressed against the support portions 88, 96 and the collar members 111 can be pushed on the rear walls 79*a* of the second guide portions 79 of the guide grooves 77. Thus, the developing cartridge 27 may be positioned in the drum sub unit 28. Therefore, the developing cartridges 27 may be prevented from being placed out of position in the drum sub units 28 when the drive force is input to the female coupling members 113.

The guide groove 77 is formed with the second guide portion 79 that is inclined substantially parallel to the upper surface 87 of the center plate 82 of the center frame 76. The second guide portion 79 and the upper surface 87, where the support portions 88 are provided, are substantially parallel to each other, so that smooth movement or sliding of the protrusions 119 on the support portions 88 may be ensured. Thus, stress applied to the support portions 88 and/or the protrusions 119 may be reduced and damages to the support portions 88 and/or the protrusions 119 may be prevented.

In the developing cartridge 27, the windows 46 for optically detecting the amount of toner in the toner chamber 43 are disposed on the line L passing through the rotation shaft 47 of the agitator 37, as an axis of the agitator 37, and the protrusions 119. The amount of toner in the toner chamber 43 may be detected, based on the light passing through the windows 46 when the agitator 37 brings the toner up to the position where the windows 46 are located.

The distance between the protrusion 119 and the window 46 is shorter than the distance between the rotation shaft 47 and the window 46. With such a structure, when the developing cartridge 27 is mounted in the relevant drum sub unit 28, an amount of deviation in the position of the window 46 resulting from dimensional tolerances of the developing cartridge 27 may be reduced. More specifically, the support portion 88 at which the protrusion 119 contacts thereto is fixed when the relevant developing cartridge 27 is mounted in the relevant drum sub unit 28. Therefore, influences of the dimensional tolerances on the position of the window 46 from the support portion 88 may be minimized as the window 46 is disposed closer to the protrusion 119 than the rotation shaft 47. Accordingly, the light for detecting the toner amount in the toner chamber 43 may pass through the windows 46 reliably, and the toner amount in the toner chamber 43 may be correctly detected based on the light.

Figure 32:
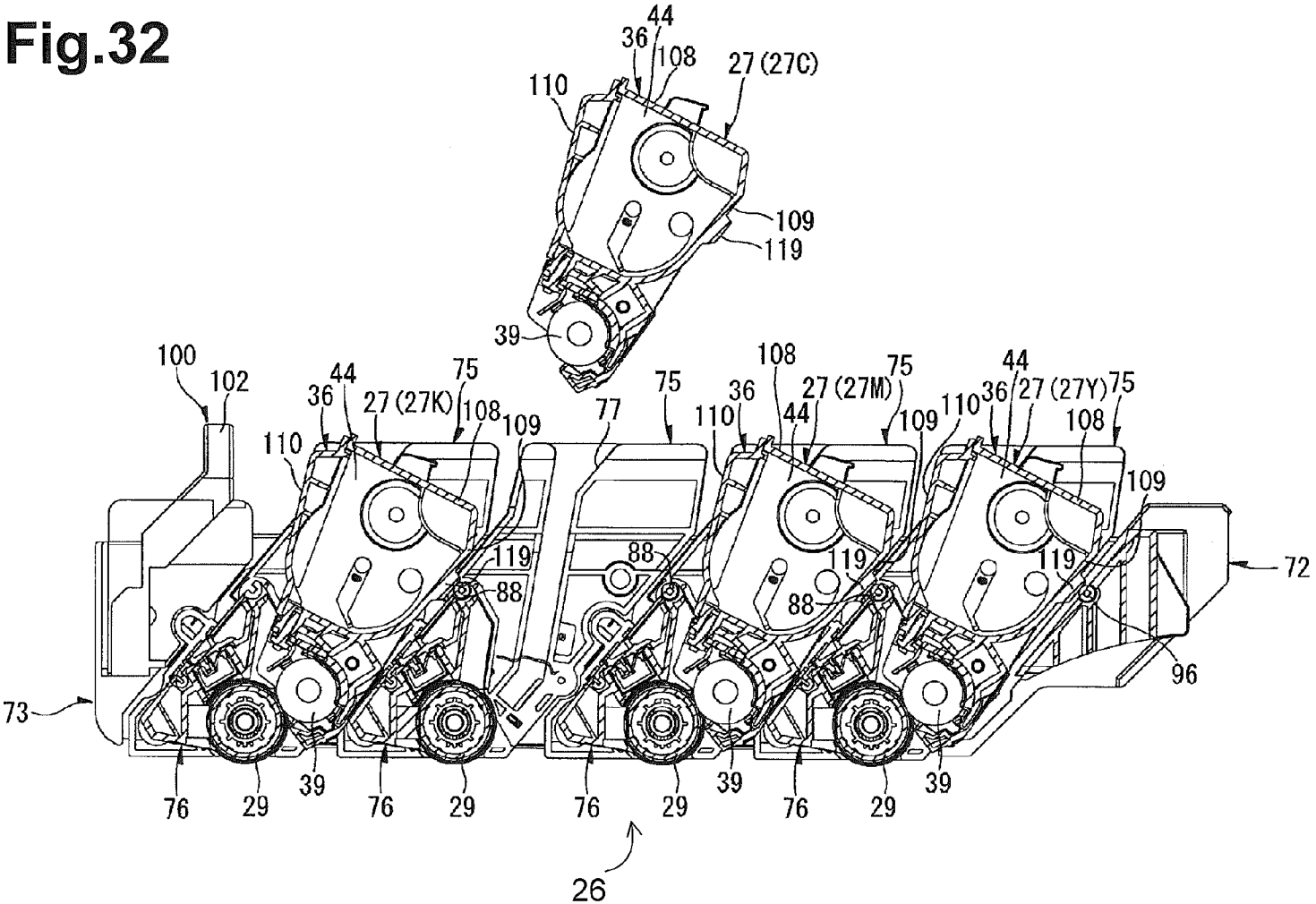
FIG. 32 is a sectional side view of a drum unit according to another aspect of the invention.
Figure 33:
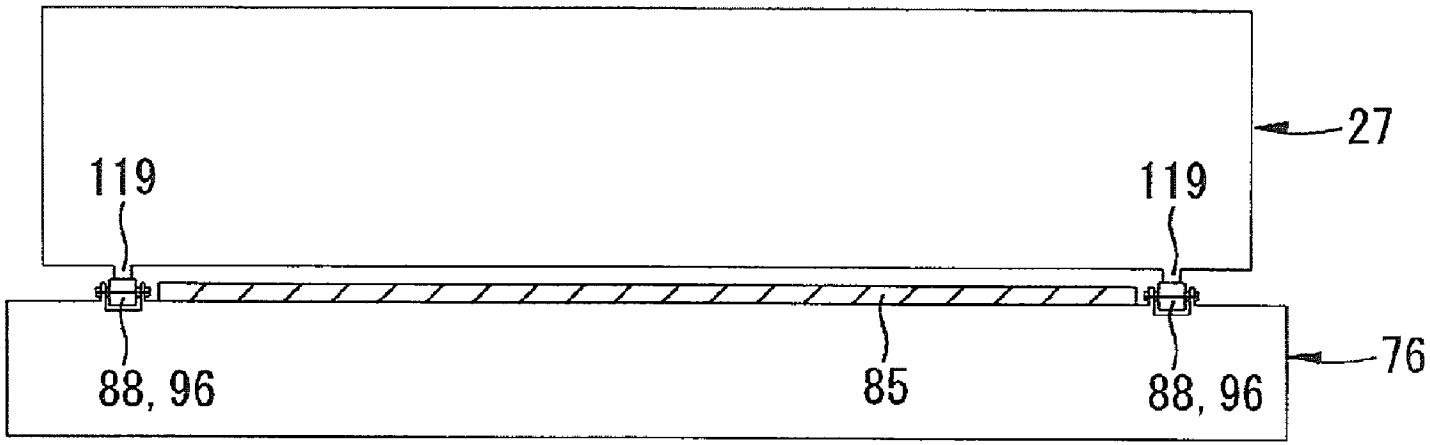
FIG. 33 is a plan view schematically showing the drum unit shown in FIG. 32.

Another aspect will be described with reference to FIGS. 32 and 33. It should be noted that like elements are labeled with like numbers in FIGS. 32 and 33 and detailed description of the like elements shown in FIGS. 32 and 33 will be omitted.

In the above aspect, the support portions 88, 96 are formed in a substantially semi-circular shape in a side view protruding toward the developing cartridge 27 when the developing cartridge 27 is mounted in the drum sub unit 28. The friction reduction tape 89, 97 is affixed to a surface of each support portion 88, 96.

In another aspect, the support portions 88, 96 may be formed of rollers extending along the longitudinal direction of the developing cartridges 27. Even when the developing cartridges 27 vibrate, the roller support portions 88, 96 will rotate so that the friction between the roller support portions 88, 96 and the projections 119 may be reduced. Thus, excessive wear of the support portions 88, 96 and the projections 119 may be reliably prevented.

Figure 34:
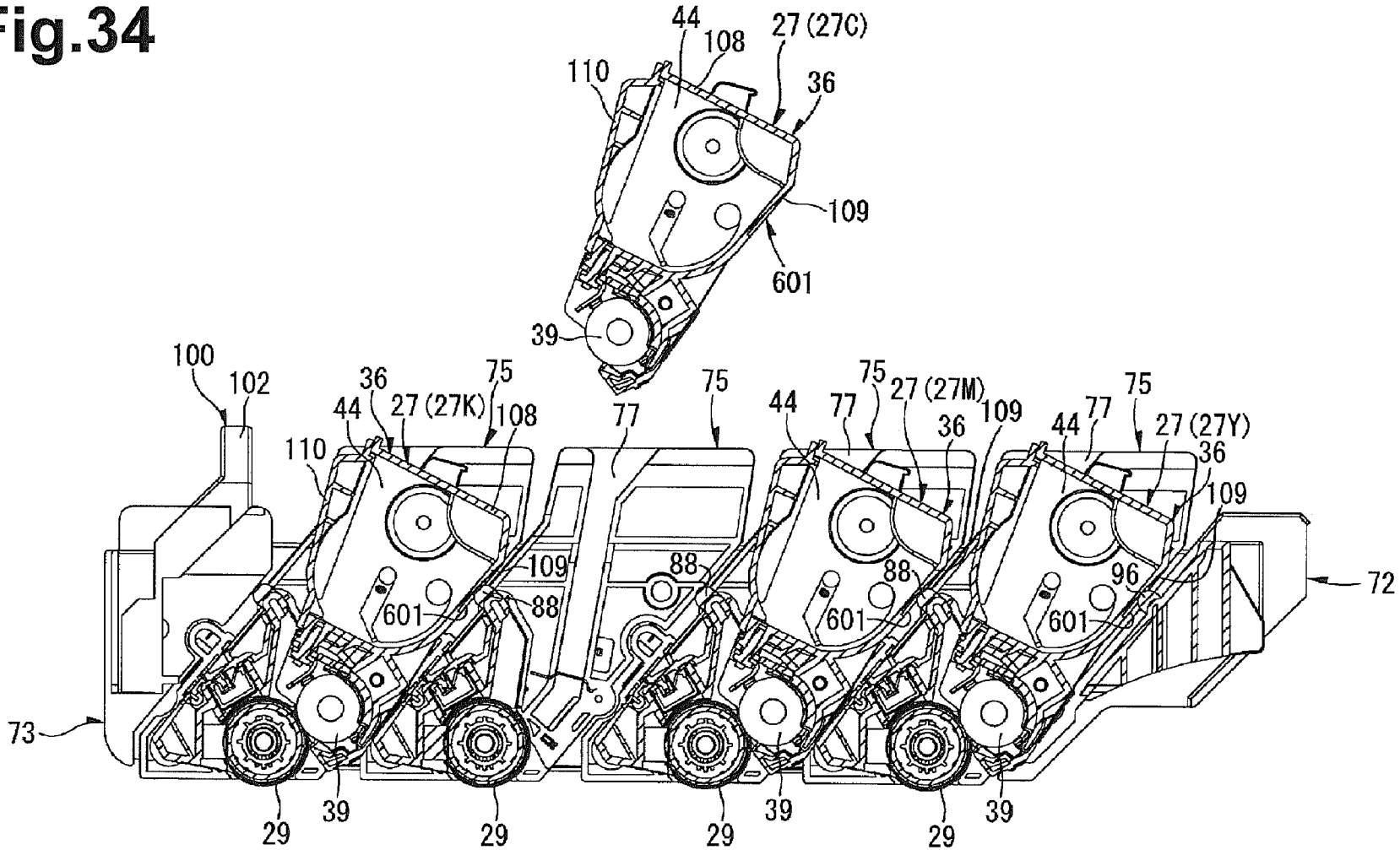
FIG. 34 is a sectional side view of a drum unit according to another aspect of the invention.
Figure 35:
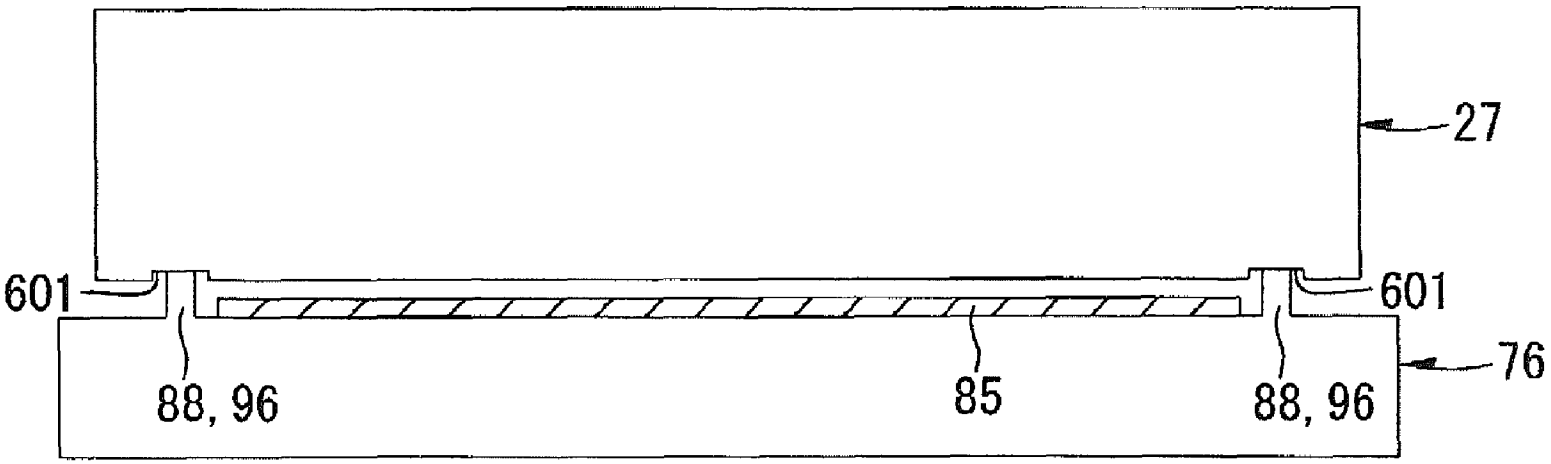
FIG. 35 is a plan view schematically showing the drum unit shown in FIG. 34.

Another aspect will be described with reference to FIGS. 34 and 35. It should be noted that like elements are labeled with like numbers in FIGS. 34 and 35 and detailed description of the like elements shown in FIGS. 34 and 35 will be omitted.

In the aspect, recesses 601 that are open in a forward direction are formed on the front wall 109 of the developing frame 36. The support portions 88, 96 are formed in a substantially semi-circular shape in a side view protruding toward the recesses 601 greater than the depth of the recesses 601. When the developing cartridge 27 is mounted in the drum sub unit 28, the support portions 88, 96 fit in the relevant recesses 601.

With such a structure, the protruding length of the projection 119 is greater than the depth of the recess 601. Thus, contact between parts or surfaces of the developing cartridge 27 other than the recesses 601 and the center frame 76/front beam 72 may be prevented. Thus, damage to the parts or surfaces of the developing cartridge 27 other than the recesses 601 may be prevented. Parts of the developing cartridge 27 other than the recesses 601 protrude toward the support portions 88, 96, so that the volumetric capacity of the toner chamber 43 may be increased. Thus, the amount of toner contained in the toner chamber 43 may be increased.

Figure 36:
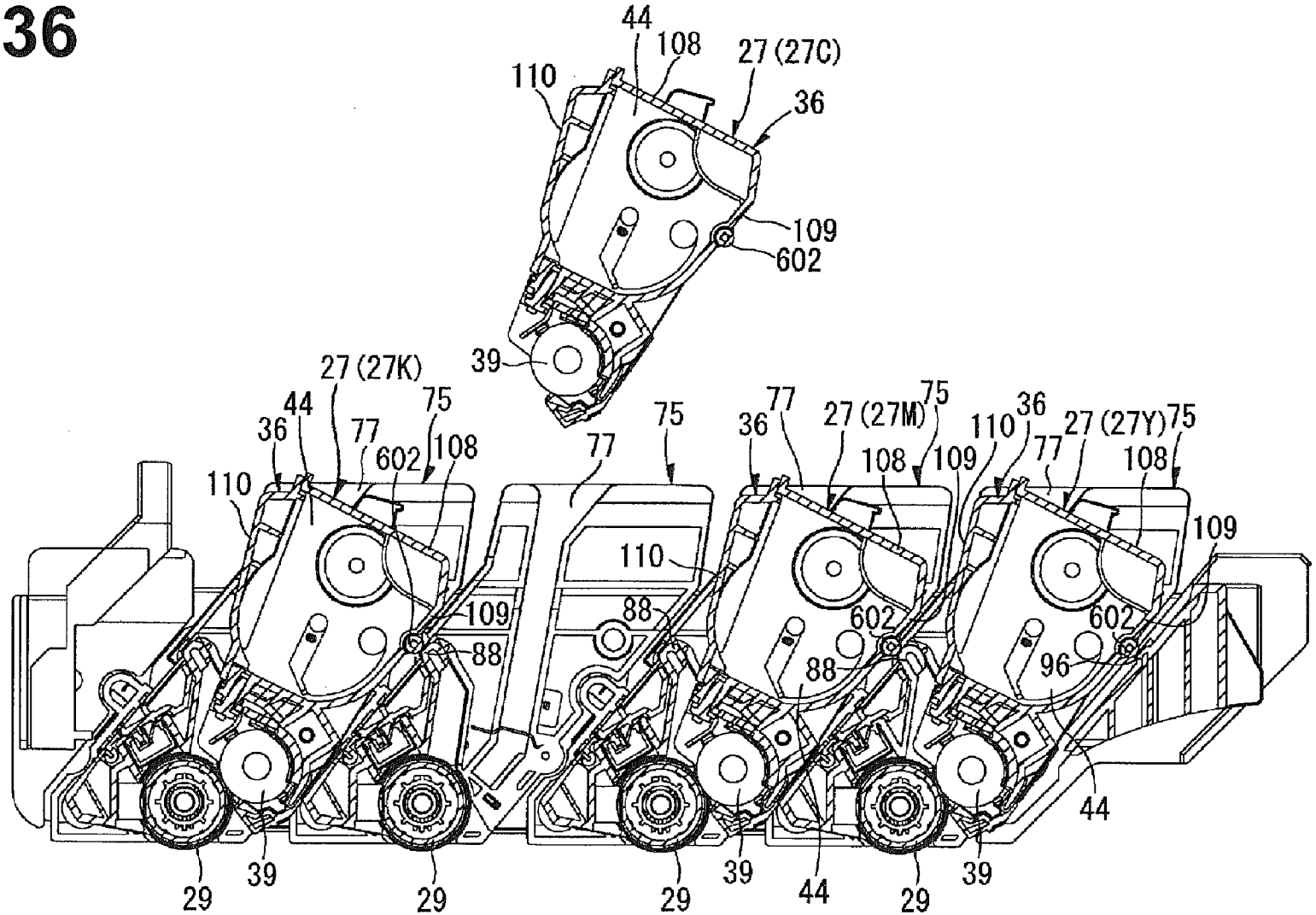
FIG. 36 is a sectional side view of a drum unit according to another aspect of the invention.
Figure 37:
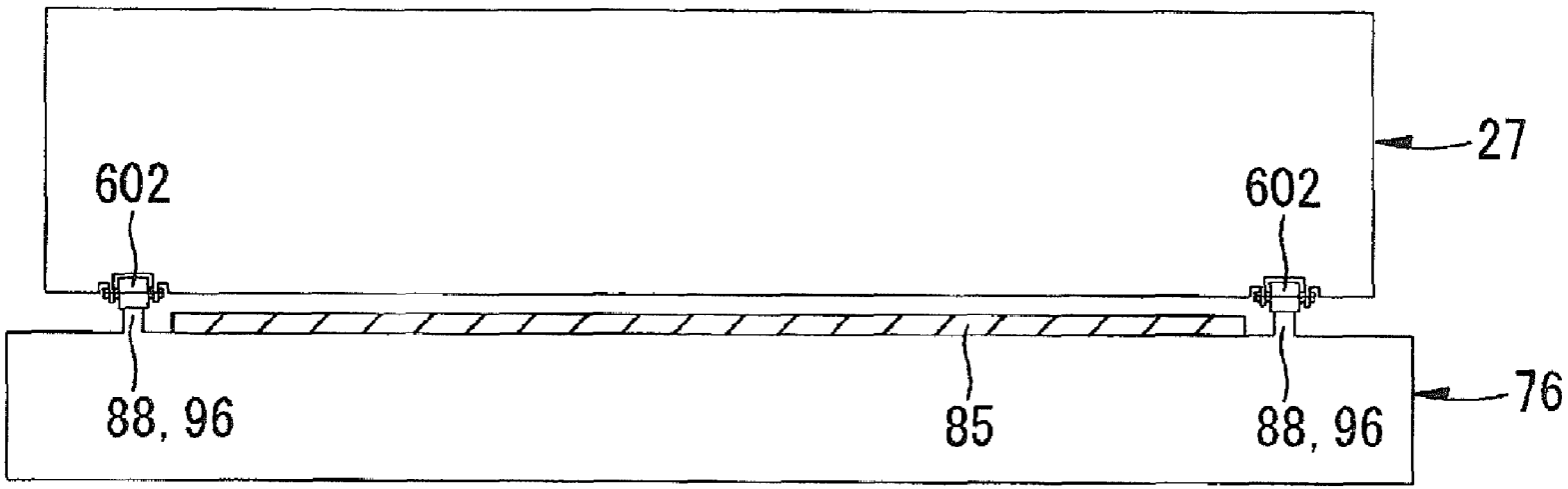
FIG. 37 is a plan view schematically showing the drum unit shown in FIG. 36.

Another aspect will be described with reference to FIGS. 36 and 37. It should be noted that like elements are labeled with like numbers in FIGS. 36 and 37 and detailed description of the like elements shown in FIGS. 36 and 37 will be omitted.

In the above aspect, the support portions 88, 96 are formed in a substantially semi-circular shape in a side view protruding toward the developing cartridge 27 when the developing cartridge 27 is mounted in the drum sub unit 28. The friction reduction tape 89, 97 is affixed to a surface of each support portion 88, 96.

In another aspect, the friction reduction tape 89, 97 is not affixed to the support portions 88, 96. Instead of the projections 119, rollers 602, which extend in the longitudinal direction of the developing cartridge 27, are disposed on the front wall 109 of the developing cartridge 27.

With such a structure, even when the developing cartridges 27 vibrate, the rollers 602 will rotate so that the friction between the support portions 88, 96 and the rollers 602 may be reduced. Thus, excessive wear of the support portions 88, 96 and the rollers 602 may be prevented.

While the invention has been described in connection with various example structures and illustrative aspects, it will be understood by those skilled in the art that other variations and modifications of the structures and aspects described above may be made without departing from the scope of the invention. Other structures and aspects will be apparent to those skilled in the art from a consideration of the specification or practice of the invention disclosed herein. It is intended that the specification and the described examples are illustrative with the true scope of the invention being defined by the following claims.

What is claimed is:

1. An image forming apparatus, comprising:

a casing;

a process unit configured to be removably installed in the casing;

a plurality of image carrier holder units arranged in a first direction, each image carrier holder unit configured to be held in the process unit; and a plurality of developing cartridges provided in correspondence with the image carrier holder units, the developing cartridges being configured to be removably mounted in the image carrier holder units;

wherein each image carrier holder unit includes:

an image carrier;

a charger configured to charge the image carrier;

a pair of side frames disposed so as to hold the image carrier therebetween;

a center frame disposed between the side frames, the center frame being configured to support the charger; and a first support portion disposed on the center frame, and wherein each developing cartridge includes:

a developer frame;

a developer carrier provided in the developer frame; and a supported portion provided in the developer frame, the supported portion configured to face the first support portion when the developing cartridge is mounted in the image carrier holder unit.

2. The image forming apparatus according to claim 1, wherein the image carrier holder unit further comprises:

a guide groove formed on each of the side frames, and wherein the developer frame further comprises:

a developing chamber configured to hold the developer carrier;

a developer container configured to contain the developer, the developer container being disposed adjacent to the developing chamber; and a projection configured to fit in the guide groove, the projection being disposed on a surface of the developing chamber facing one of the side frames when the developing cartridge is mounted in the image carrier holder unit.

3. The image forming apparatus according to claim 2, wherein the developing cartridge includes an input gear, the projection being configured to be pressed against an inner surface of the guide groove by a moment of rotation of the input gear.

4. The image forming apparatus according to claim 3, wherein the supported portion is configured to be pressed against the first support portion by the moment of rotation of the input gear.

5. The image forming apparatus according to claim 2, wherein the guide groove includes a first guide portion and a second guide portion, the first guide portion being configured to guide the developing cartridge out of and into the image carrier holding unit, the second guide portion being configured to guide the developer carrier when the developer carrier is driven.

6. The image forming apparatus according to claim 5, wherein the second guide portion is substantially parallel with a surface of the center frame where the first support portion is disposed.

7. The image forming apparatus according to claim 1, wherein the process unit further comprises:

a pair of side plates configured to sandwich the plurality of image carrier holder units therebetween in a second direction perpendicular to the first direction;

a beam member disposed between the side plates at one end of the process unit in the first direction; and a second support portion disposed on the beam member, wherein the developing cartridge corresponding the image carrier holder unit adjacent to the beam member is supported at the supported portion by the second support portion when the developing cartridge is mounted in the image carrier holder unit adjacent to the beam member.

8. The image forming apparatus according to claim 1, wherein the first support portion includes a member having a lower frictional coefficient than the center frame.

9. The image forming apparatus according to claim 8, wherein the member includes a tape.

10. The image forming apparatus according to claim 8, wherein the member includes a roller.

11. The image forming apparatus according to claim 1, wherein the supported portion includes a protrusion that projects toward the first support portion.

12. The image forming apparatus according to claim 11, wherein the image carrier holder unit includes a charger cover configured to cover the charger, the charger cover being disposed at the center frame in a space defined by the protrusion between the center frame and the developing cartridge when the supported portion is supported by the first support portion.

13. The image forming apparatus according to claim 1, wherein the first support portion includes a protrusion projecting toward the supported portion, and wherein the supported portion includes a recess configured to receive the protrusion.

14. The image forming apparatus according to claim 13, wherein the image carrier holder unit includes a charger cover configured to cover the charger, the charger cover being disposed at the center frame in a space defined by the protrusion between the center frame and the developing cartridge when the supported portion is supported by the first support portion.

15. The image forming apparatus according to claim 14, wherein the developing cartridge includes an input gear, and rotation of the input gear applies a moment of rotation to the developing cartridge, and wherein a direction of the moment is substantially parallel to a direction of force applied at the supported portion to the first support portion.

16. The image forming apparatus according to claim 1, wherein the supported portion includes a roller.

17. The image forming apparatus according to claim 1, wherein the developing cartridge is disposed at an angle, when mounted to the image carrier holder unit, at which the supported portion contacts the first support portion.

18. A process unit configured to be used in an image forming device, the process unit comprising:

a plurality of image carrier holder units arranged in a first direction, each image carrier holder unit configured to be held in the process unit; and a plurality of developing cartridges provided in correspondence with the image carrier holder units, the developing cartridges being configured to be removably mounted in the image carrier holder units;

wherein each image carrier holder unit includes:

an image carrier;

a charger configured to charge the image carrier;

a pair of side frames disposed so as to hold the image carrier therebetween;

a center frame disposed between the side frames, the center frame being configured to support the charger; and a first support portion disposed on the center frame, and wherein each developing cartridge includes:

a developer frame;

a developer carrier provided in the developer frame; and a supported portion provided in the developer frame, the supported portion configured to face the first support portion when the developing cartridge is mounted in the image carrier holder unit.

19. The process unit according to claim 18, wherein the image carrier holder unit further comprises:

a guide groove formed on each of the side frames, and wherein the developer frame further comprises:

a developing chamber configured to hold the developer carrier;

a developer container configured to contain the developer, the developer container being disposed adjacent to the developing chamber; and a projection configured to fit in the guide groove, the projection being disposed on a surface of the developing chamber facing one of the side frames when the developing cartridge is mounted in the image carrier holder unit.

20. The process unit according to claim 19, wherein the developing cartridge includes an input gear, the projection being configured to be pressed against an inner surface of the guide groove by a moment of rotation of the input gear.

21. The process unit according to claim 20, wherein the supported portion is configured to be pressed against the first support portion by the moment of rotation of the input gear.

22. The process unit according to claim 19, wherein the guide groove includes a first guide portion and a second guide portion, the first guide portion being configured to guide the developing cartridge out of and into the image carrier holding unit, the second guide portion being configured to guide the developer carrier when the developer carrier is driven.

23. The process unit according to claim 22, wherein the second guide portion is substantially parallel with a surface of the center frame where the first support portion is disposed.

24. The process unit according to claim 18, wherein the process unit further comprises:

a pair of side plates configured to sandwich the plurality of image carrier holder units therebetween in a second direction perpendicular to the first direction;

a beam member disposed between the side plates at one end of the process unit in the first direction; and a second support portion disposed on the beam member, wherein the developing cartridge associated with the image carrier holder unit adjacent to the beam member is supported at the supported portion by the second support portion when the developing cartridge is mounted in the image carrier holder unit adjacent to the beam member.

25. The process unit according to claim 18, wherein the first support portion includes a member having a lower frictional coefficient than the center frame.

26. The process unit according to claim 25, wherein the member includes a tape.

27. The process unit according to claim 25, wherein the member includes a roller.

28. The process unit according to claim 18, wherein the supported portion includes a protrusion that projects toward the first support portion.

29. The process unit according to claim 28, wherein the image carrier holder unit includes a charger cover configured to cover the charger, the charger cover being disposed at the center frame in a space defined by the protrusion between the center frame and the developing cartridge when the supported portion is supported by the first support portion.

30. The process unit according to claim 18, wherein the first support portion includes a protrusion projecting toward the supported portion, and wherein the supported portion includes a recess configured to receive the protrusion.

31. The process unit according to claim 30, wherein the image carrier holder unit includes a charger cover configured to cover the charger, the charger cover being disposed at the center frame in a space defined by the protrusion between the center frame and the developing cartridge when the supported portion is supported by the first support portion.

32. The process unit according to claim 31, wherein the developing cartridge includes an input gear, and rotation of the input gear applies a moment of rotation to the developing cartridge, and wherein a direction of the moment is substantially parallel to a direction of force applied at the supported portion to the first support portion due to weight of the developing cartridge.

33. The process unit according to claim 18, wherein the supported portion includes a roller.

34. The process unit according to claim 18, wherein the developing cartridge is disposed at an angle, when mounted to the image carrier holder unit, at which the supported portion contacts the first support portion.

35. A developing cartridge attachable to and detachable from an image carrier holder unit, comprising:

a developer frame;

a developer carrier provided in the developer frame;

a developer container provided in the developer frame and configured to contain developer;

an agitator configured to agitate the developer in the developer container;

a window configured to allow light passing therethrough to optically detect an amount of developer in the developer container; and a supported portion provided in the developer frame and disposed on a line connecting an axis of the agitator and the window.

36. The developing cartridge according to claim 35, wherein the supported portion includes a roller.

37. The developing cartridge according to claim 35, wherein the window is disposed between the supported portion and the axis, and is closer to the supported portion than the axis.

38. The developing cartridge according to claim 35, wherein the supported portion is configured to face a center frame of the image carrier holder unit when the developing cartridge is mounted in the image carrier holder unit.

39. The developing cartridge according to claim 38, wherein the developer frame further comprises:

a developing chamber configured to hold the developer carrier, the developer chamber being adjacent to the developing container;

a developer container configured to contain the developer; and a projection configured to fit in a guide groove of the image carrier holder unit, the projection being disposed on a surface of the developing chamber, the surface facing a side frame of the image carrier holder unit when the developing cartridge is mounted in the image carrier holder unit.

40. A developing cartridge, comprising:

a developer frame;

a developer carrier provided in the developer frame;

a developer container provided in the developer frame and configured to contain developer;

an agitator, supported by the developer frame, and configured to agitate the developer in the developer container;

a supported portion provided in the developer frame; and a light passing portion provided in the developer frame, and configured to allow light passing through the light passing portion to optically detect the developer in the developer container, wherein the light passing portion is disposed on a line connecting an axis of the agitator and the supported portion.

41. The developing cartridge according to claim 40, wherein the supported portion includes a roller.

42. The developing cartridge according to claim 40, wherein the light passing portion is disposed between the axis and the supported portion, and is closer to the supported portion than the axis.

43. The developing cartridge according to claim 40, wherein the supported portion is configured to face a center frame of an image carrier holder unit when the developing cartridge is mounted in the image carrier holder unit.

44. The developing cartridge according to claim 43, wherein the developer frame further comprises:

a developing chamber configured to hold the developer carrier, the developer chamber being adjacent to the developer container; and a projection configured to fit in a guide groove of the image carrier holder unit, the projection being disposed on a surface of the developing chamber, the surface facing a side frame of the image carrier holder unit when the developing cartridge is mounted in the image carrier holder unit.

45. A developing cartridge, comprising:

a developer frame;

a developer carrier provided in the developer frame;

a developer container provided in the developer frame and configured to contain developer;

an agitator, supported by the developer frame, and configured to agitate the developer in the developer container;

a supported portion provided in the developer frame; and means, provided in the developer frame, for allowing light passing therethrough to optically detect the developer in the developer container, wherein the allowing means is disposed on a line connecting an axis of the agitator and the supported portion.

46. An image forming apparatus, comprising:

a casing;

a process unit configured to be removably installed in the casing;

a plurality of image carriers arranged in the process unit;

a plurality of center frames arranged in a first direction, each center frame configured to be held in the process unit and in correspondence with each image carrier; and a plurality of developing cartridges, each provided in correspondence with each center frame, each developing cartridge being configured to be removably mounted in the process unit;

wherein each center frame comprises:

a charger configured to charge a corresponding image carrier, the center frame being configured to support the charger; and a first support portion, and wherein each developing cartridge comprises:

a developer frame;

a developer carrier provided in the developer frame; and a supported portion provided in the developer frame, the supported portion configured to face the first support portion when the developing cartridge is mounted in the process unit.

* * * * *